US008576027B2

(12) United States Patent
Kushta

(10) Patent No.: US 8,576,027 B2
(45) Date of Patent: Nov. 5, 2013

(54) DIFFERENTIAL-COMMON MODE RESONANT FILTERS

(75) Inventor: Taras Kushta, Tokyo (JP)

(73) Assignee: NEC Corporation, Tokyo (JP)

( * ) Notice: Subject to any disclaimer, the term of this patent is extended or adjusted under 35 U.S.C. 154(b) by 459 days.

(21) Appl. No.: 12/810,200

(22) PCT Filed: Dec. 25, 2007

(86) PCT No.: PCT/JP2007/075358

§ 371 (c)(1),
(2), (4) Date: Sep. 10, 2010

(87) PCT Pub. No.: WO2009/081504

PCT Pub. Date: Jul. 2, 2009

(65) Prior Publication Data

US 2010/0321135 A1 Dec. 23, 2010

(51) Int. Cl.
*H01P 1/203* (2006.01)
*H01P 7/08* (2006.01)

(52) U.S. Cl.
USPC ..... 333/204; 333/205; 333/219; 333/235

(58) Field of Classification Search
USPC ..... 333/204, 205, 206, 208, 219, 235
See application file for complete search history.

(56) References Cited

U.S. PATENT DOCUMENTS

| | | | | |
|---|---|---|---|---|
| 4,543,543 | A * | 9/1985 | Blight et al. | 333/24.1 |
| 5,321,373 | A | 6/1994 | Shusterman et al. | |
| 6,020,800 | A * | 2/2000 | Arakawa et al. | 333/208 |
| 6,236,290 | B1 * | 5/2001 | Abe et al. | 333/185 |
| 6,528,732 | B1 * | 3/2003 | Okubora et al. | 174/255 |
| 6,642,672 | B2 | 11/2003 | Hu et al. | |
| 6,992,548 | B2 * | 1/2006 | Fukunaga | 333/208 |
| 7,011,725 | B2 * | 3/2006 | Geller et al. | 156/89.17 |
| 7,068,127 | B2 * | 6/2006 | Wilber et al. | 333/202 |
| 8,283,108 | B2 * | 10/2012 | Chiu et al. | 430/311 |
| 2002/0190817 | A1 * | 12/2002 | Berry et al. | 333/202 |
| 2005/0063127 | A1 | 3/2005 | Anthony | |
| 2005/0212625 | A1 * | 9/2005 | Celinski et al. | 333/204 |

FOREIGN PATENT DOCUMENTS

| | | | |
|---|---|---|---|
| JP | 62-92601 | A | 4/1987 |
| JP | 9-246821 | A | 9/1997 |
| JP | 10-303618 | A | 11/1998 |
| JP | 11-81007 | A | 3/1999 |
| JP | 2003037022 | A | 2/2003 |
| JP | 2003078312 | A | 3/2003 |
| WO | 2007046271 | A | 4/2007 |

OTHER PUBLICATIONS

Johanson Catalog 2010 (Microwave Tuning Elements . . . ) http://www.johansonmfg.com/.*

International Search Report for PCT/JP2007/075358 mailed Mar. 25, 2008.

* cited by examiner

*Primary Examiner* — Benny Lee
*Assistant Examiner* — Rakesh Patel

(57) ABSTRACT

A filter is provided with a multilayer board incorporating a resonator formed by two ground plates opposed to each other and conductive side walls connected to the ground plates; two signal vias provided through the resonator; and two terminals connected to the signal vias to receive a pair of signals. The resonator has a first face of symmetry vertical to the ground plates. The signal vias are disposed symmetrically with respect to the first face of symmetry on a distance from the first face of symmetry.

23 Claims, 35 Drawing Sheets

DIFFERENTIAL-COMMON MODE RESONANT FILTERS

This application is the National Phase of PCT/JP2007/075358, filed Dec. 25,2007.

TECHNICAL FIELD

The present invention relates to differential mode and common mode filtering components based on multilayer board technologies for digital, analog or mixed digital and analog systems in communication and computing devices.

BACKGROUND ART

Signaling by means of two complementary signals sent on two separate conductors, which is often referred to as differential signaling, is widely-used in modern high-frequency and high-speed digital and analog devices because of clearly-expressed advantages as compared to single-ended signaling. As for an example, differential signaling can considerably reduce noise in data transmission channels and radiation issues. Also, because differential and common modes (odd and even mode definition is also used in transmission line theory) are orthogonal ones, then both of these modes can be used in data transmission to increase capacity of the channels.

That is why, it is important to control a frequency response for the differential and common modes, or to provide separation of the differential and common modes, or suppressing one of these modes to make independent their receiving and transmitting.

From this viewpoint, differential-common mode filters are crucial components in analog and digital devices. Also it is important to make the filters as cost-effective components which can be easily integrated in a multifunctional system using in the devices.

U.S. Pat. No. 5,321,373 discloses a combined differential-mode common-mode filter. This filter has a plurality of U-shaped wires passing through a ferrite core.

U.S. Pat. No. 6,642,672 discloses an integrated filter with common-mode and differential-mode functions. This filter comprises a magnetic core, two windings and a frame for installing the windings.

US Patent Application Publication No. 2005/0063127A1 discloses a paired multi-layered dielectric independent passive component architecture resulting in differential and common mode filtering.

However, proposed common and differential mode filters do not provide selective separation of the differential and common modes in frequency domain and do not have a system to intensify a loss of the common mode, or the differential mode or both these modes in a predetermined frequency band.

DISCLOSURE OF INVENTION

Therefore, an object of the present invention is to provide a technique for providing selective separation of the differential and common modes in frequency domain.

In one exemplary embodiment of the present invention, a filter is provided with a multilayer board incorporating a resonator formed by two ground plates opposed to each other and conductive side walls connected to the ground plates; two signal vias provided through the resonator; and two terminals connected to the signal vias to receive a pair of signals. The resonator has a first face of symmetry vertical to the ground plates. The signal vias are disposed symmetrically with respect to the first face of symmetry on a distance from the first face of symmetry.

BRIEF DESCRIPTION OF DRAWINGS

The above and other objects, advantages and features of the present invention will be more apparent from the following description of certain exemplary embodiments taken in conjunction with the accompanying drawings, in which.

BEST MODE FOR CARRYING OUT THE INVENTION

Figure 1A:
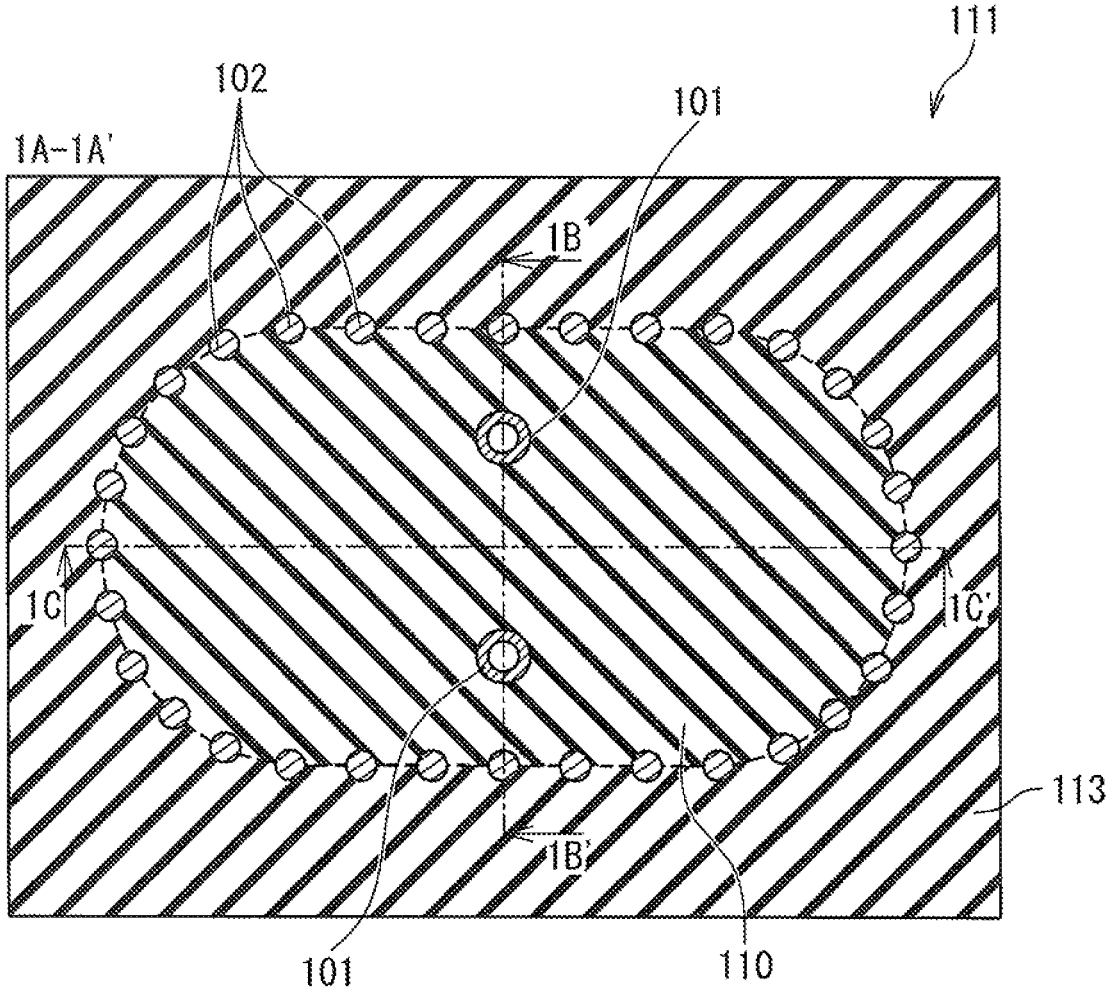
FIG. 1A is a horizontal cross-sectional view of a differential-common mode resonant filter according to one exemplary embodiment of the present invention.
Figure 1B:
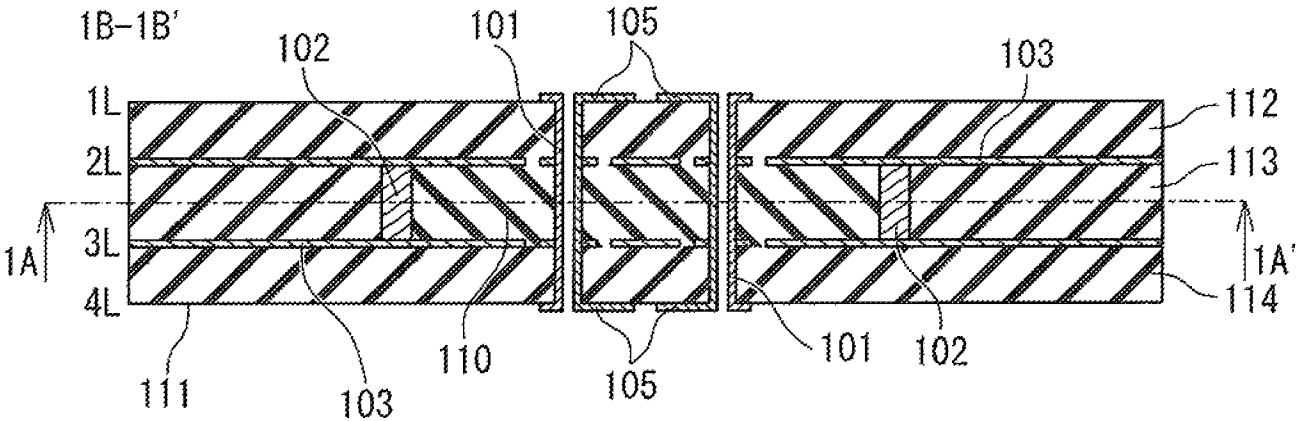
FIG. 1B is a vertical cross-sectional view of the filter on the face 1B-1B' as shown in FIG. 1A.
Figure 1C:
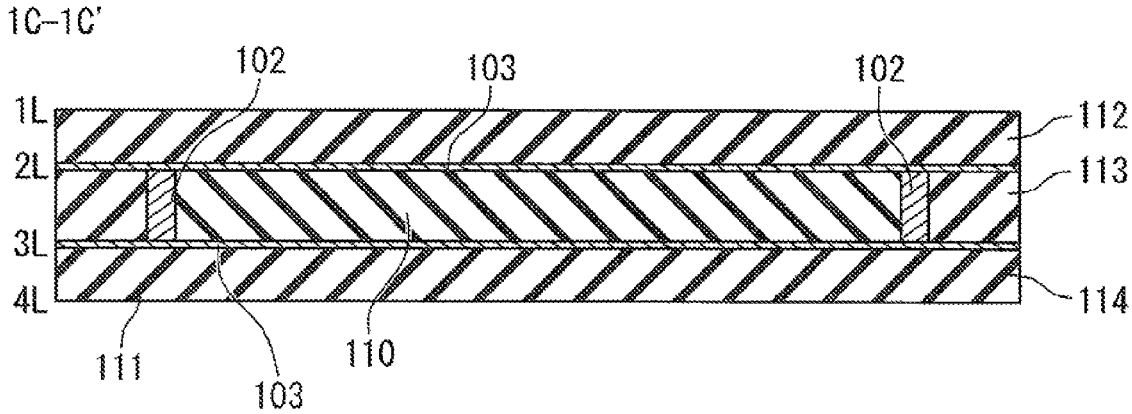
FIG. 1C is a vertical cross-sectional view of the filter on the face 1C-1C' as shown in FIG. 1A.

Hereinafter, differential-common mode resonant filters according to exemplary embodiments of according to the present invention will be described with reference to the attached drawings.

In FIGS. 1A to 1D, an exemplary embodiment of a differential-common mode resonant filter is shown. The filter is provided with two signal vias 101 disposed through a resonator 110 formed in a multilayer board 111. In this exemplary embodiment, the multilayer board 111 is provided with three isolation substrates 112 to 114 made of isolating material. It should be noted that the portion of the isolation substrate 113 within the resonator 110 is indicated by a hatching different from that of the remaining portion for illustration purposes only (the same goes for other figures). The isolating material may be dielectric material, electromagnetic wave absorbing material, or magnetic material. A first conductor layer 1L is provided on the top surface of the isolation substrate 112, a second conductor layer 2L is provided between the isolation substrates 112 and 113, a third conductor layer 3L is provided between the isolation substrates 113 and 114, and a fourth conductor layer L4 is provided on the rear surface of the isolation substrate 114.

Figure 1D:
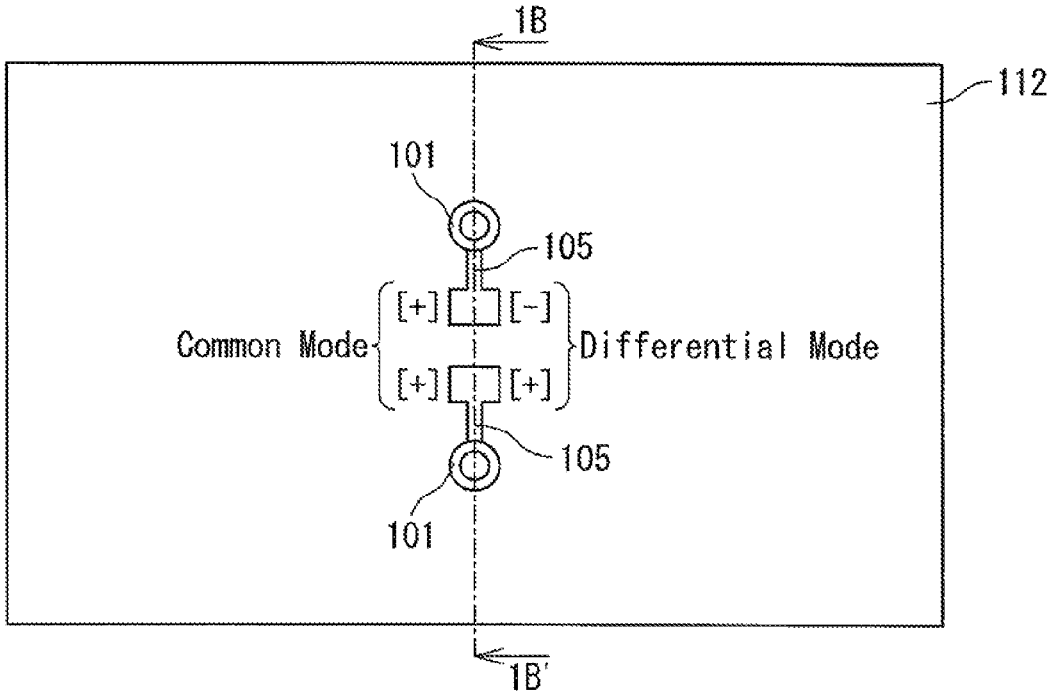
FIG. 1D is a top view of the filter.
Figure 2A:
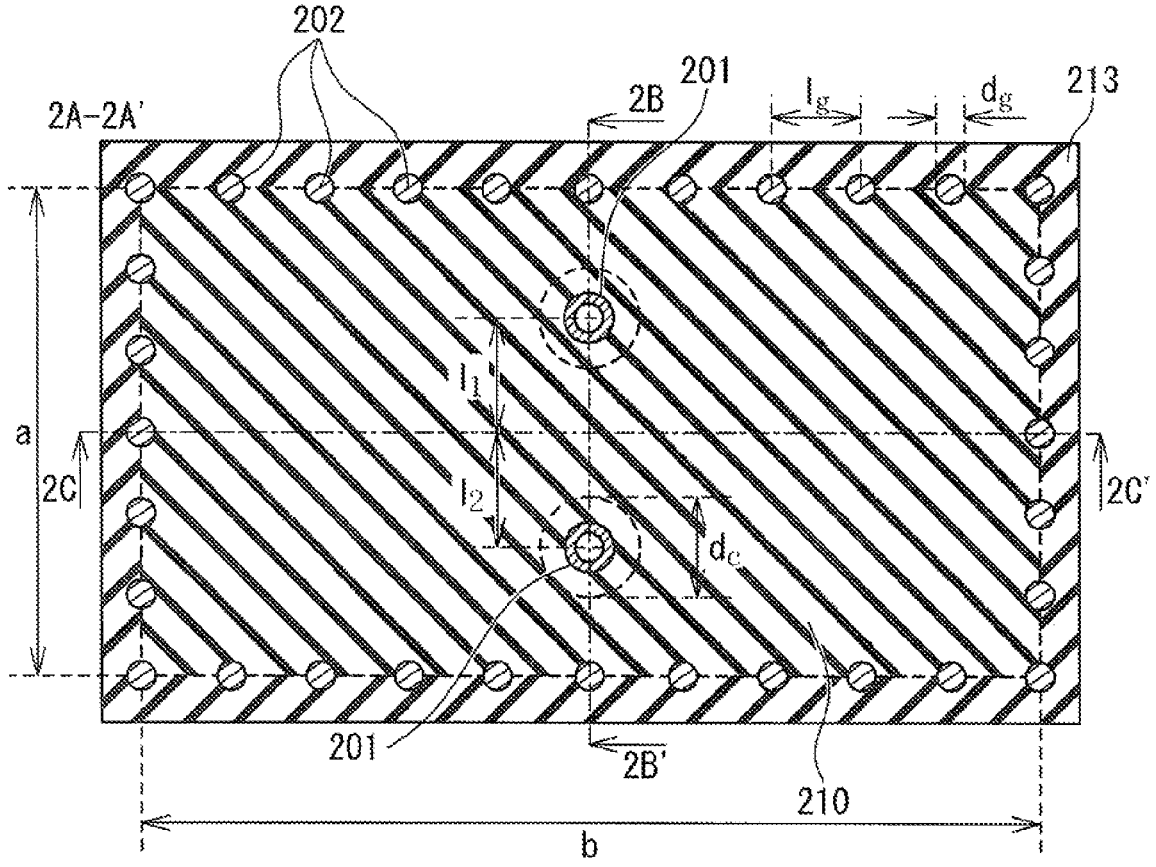
FIG. 2A is a horizontal cross-sectional view of a differential-common mode resonant filter according to another exemplary embodiment of the present invention.
Figure 2B:
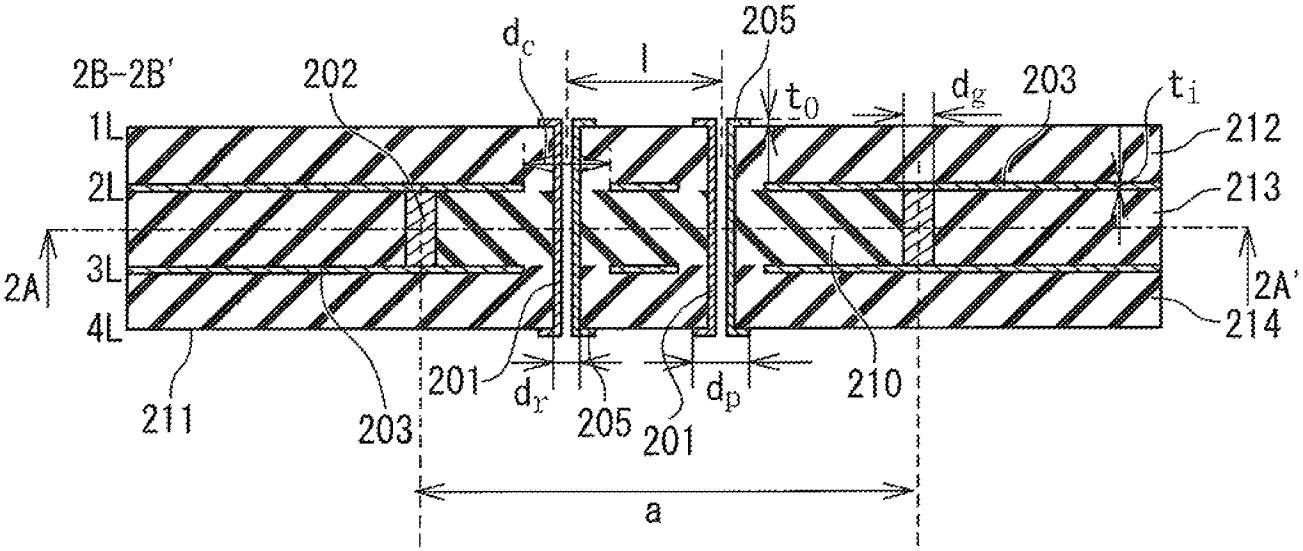
FIG. 2B is a vertical cross-sectional view of the filter on the face 2B-2B' as shown in FIG. 2A.
Figure 2C:
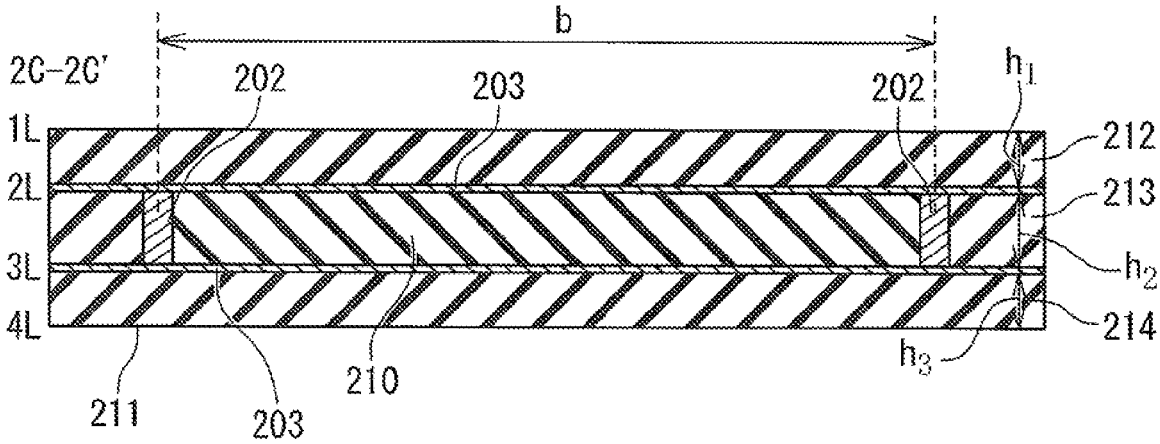
FIG. 2C is a vertical cross-sectional view of the filter on the face 2C-2C' as shown in FIG. 2A.
Figure 2D:
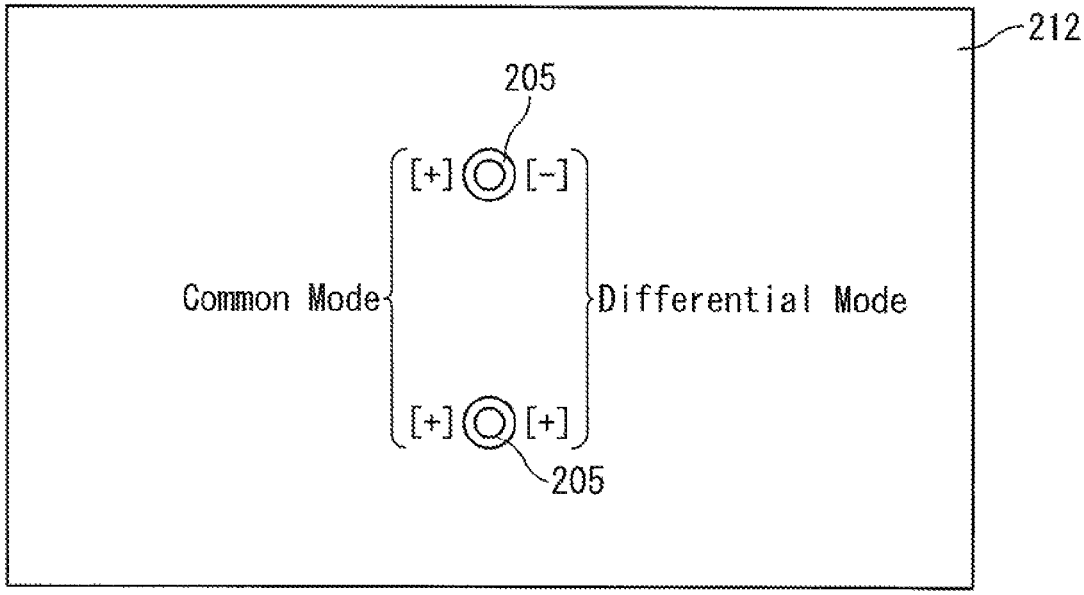
FIG. 2D is a top view of the filter.
Figure 2E:
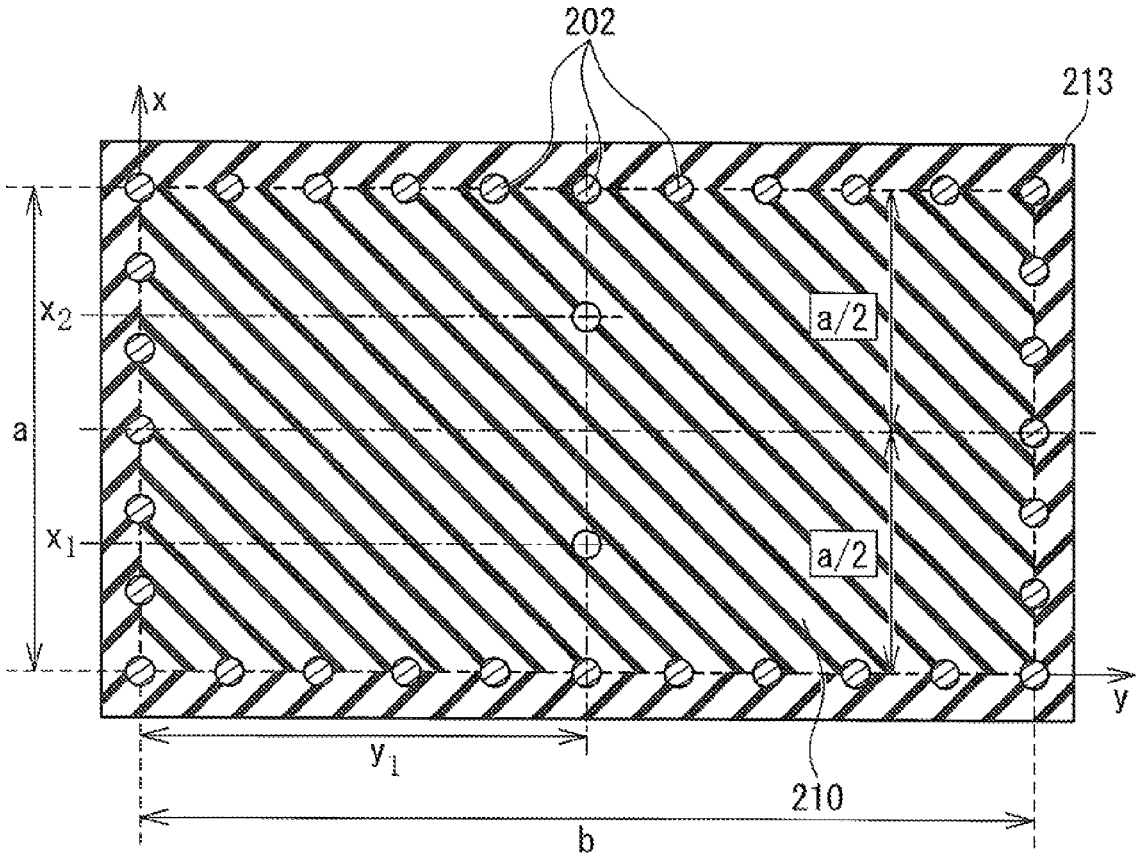
FIG. 2E illustrates the geometry of the resonator of the filter.

The resonator 110 is formed by ground vias 102 and two ground plates 103 opposed to each other. The ground vias 102 form side walls of the resonator 110 and are connected to the ground plates 103. The ground plates 103 are arranged at the second and third conductor layers 2L and 3L, separated by the isolation substrate 113. It should be noted that the portion of the isolation substrate 113 within the resonator 110 is indicated by a different hatching than that indicating the portion outside the resonator 110. In this example, the ground vias 102 are arranged in such way to configure the resonator 110 having two vertical faces of symmetry as B-B' and C-C'. Two signal vias 101, which are disposed on the face B-B' and equally spaced from the face C-C', are connected to two terminals 105 formed here as a microstrip structure. As input signals, differential and common modes are entered in the terminals 105 as shown in FIG. 1D.

It is well-known that two signal conductors disposed in the vicinity of a ground or a power supply conductor can support two orthogonal modes as differential and common ones (also called mixed modes). These modes can be used as propagating signals carrying information in a system included in a device.

However due to impedance inhomogeneity, transformation between the differential and common modes can be considerable that can dramatically increase noise in useful signals and also radiation from the device in which signaling on a mixed mode (differential or common one) is applied.

Accordingly, providing separated transmitting and receiving of the differential and common modes or cancellation one of these modes is a crucial problem.

Particularly, this problem is solved by the differential-common mode resonant filter of the present exemplary embodiment. In the present exemplary embodiment, in which the resonator 110 has two faces of symmetry, the signal vias 101 lie on one of the faces and are disposed symmetrically with respect to the other face of symmetry.

Signals are propagating from terminals 105 disposed on the top conductor layer 1L of the board 111 to corresponding terminals 105 disposed on the bottom conductor layer 4L of the board. Application of the resonator 110 gives the distinguishing properties of the proposed filter.

Consider a numerical example of the differential-common mode resonant filter as shown in FIGS. 2A-2E. In these figures, the filter with a rectangular form of the resonator 210 is formed in a four-conductor-layer board 211 and signal via pads 205 are used as terminals. The four-conductor-layer board 211 is provided with three isolation substrates 212 to 214. The differential mode and common mode are propagating between top and bottom signal via pads 205. The dimensions of both signal vias 201, separated by 1=5 mm in the present example of the filter, are as following: $d_r$=0.65 mm; $d_p$=0.95 mm; $d_c$=1.65 mm, where $d_r$ is the external diameter of the signal vias 201, $d_p$ is the external diameter of the signal via pads 205, and $d_c$ is the diameter of the holes provided through the inner conductor layers 203 through which the signal vias 201 are disposed. The resonator 210 is formed between the second and third conductor layers 2L and 3L of the four-conductor-layer board 211 in which the distance between neighboring conductor layers is $h=h_1=h_2=h_3=0.75$ mm, the thickness of the top and bottom conductor layers 1L and 4L is $t_o$=0.055 mm, and the thickness of the inner conductor layers 203 forming the resonator 210.1 is $t_i$=0.035 mm. Isolating material between the ground plates 203 of the board 211 has $\epsilon$=4.0, $\mu$=1.0 and tan $\delta$=0.023, where $\epsilon$ is the relative permittivity, $\mu$ is the relative permeability and tan $\delta$ is dielectric loss tangent.

The resonator 210 is obtained by ground vias 202 forming its side walls which are connected to both inner conductor layers 203 serving as top and bottom conductive boundaries of the resonator 210. These ground via side walls are formed by the ground vias 202 of the diameter of $d_g$=0.3 mm which are equally-separated by the distance of $l_g$=1.0 mm. The horizontal dimensions of the resonator 210 are a=20 mm and b=40 mm. Note that these dimensions are defined as the distance between lines of an imagined contour passing through the center of the ground vias 202.

Figure 3:
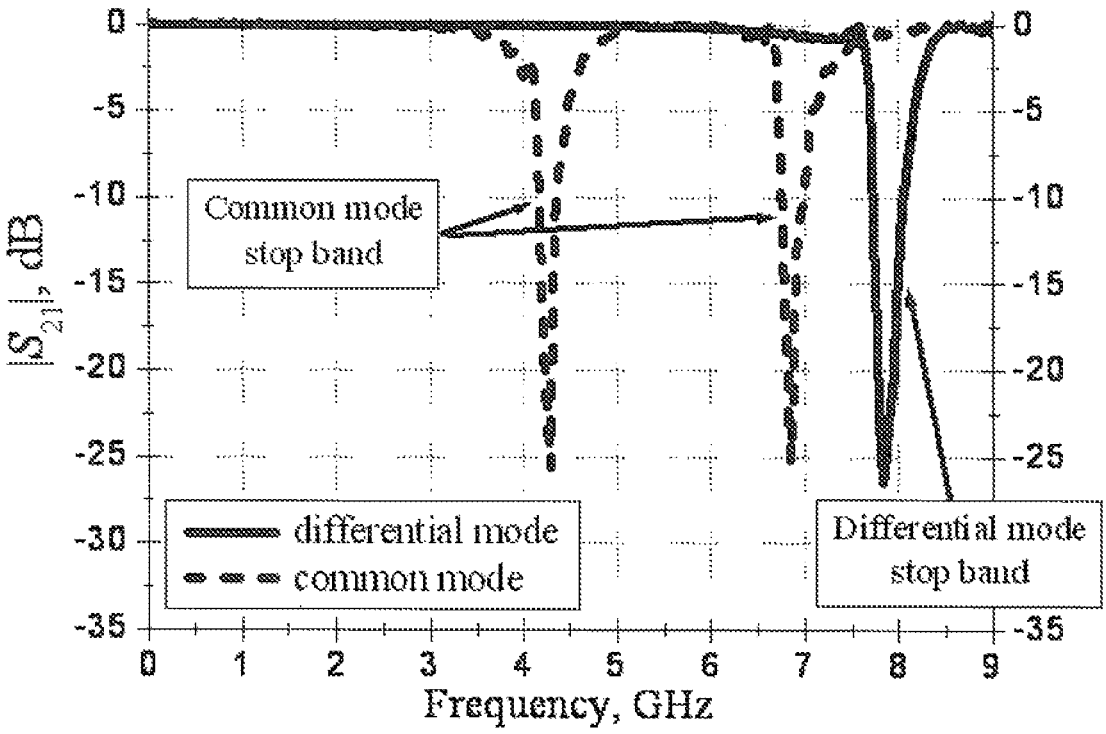
FIG. 3 is a graph illustrating insertion losses of the differential-common mode resonant filter with rectangular arrangement of side walls.
Figure 4A:
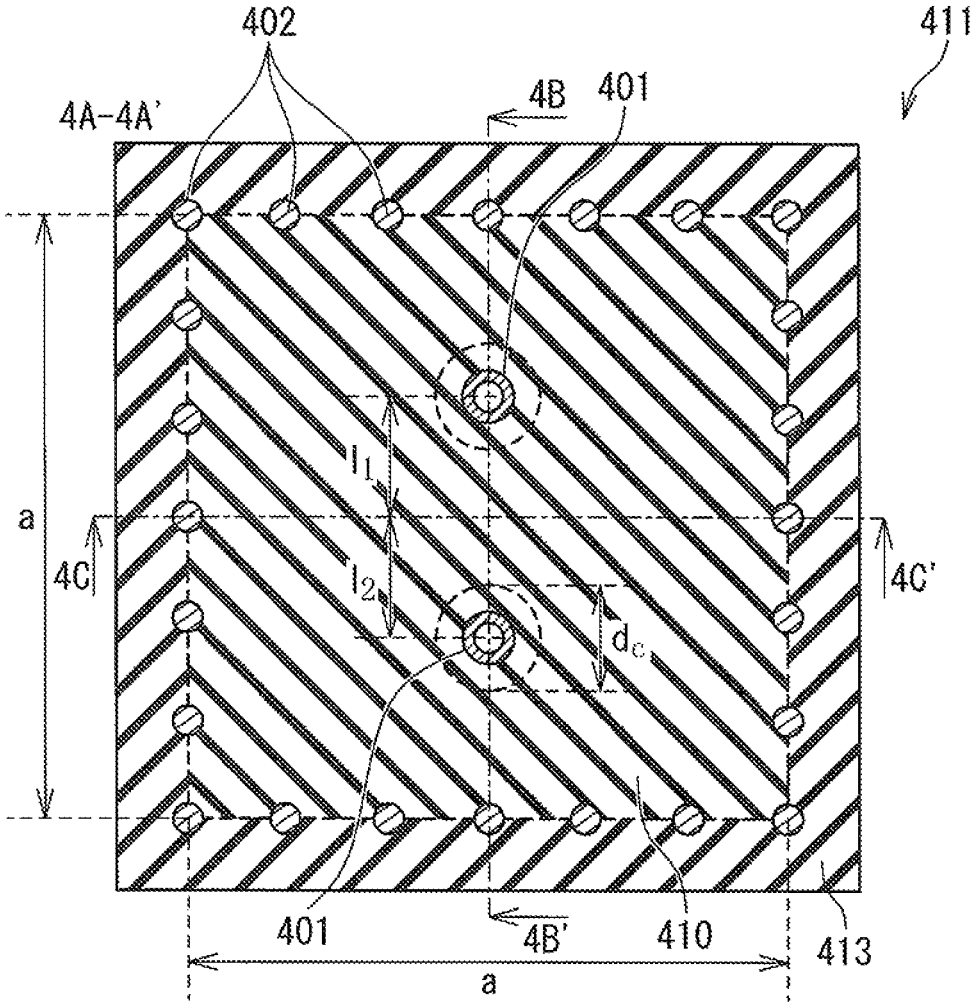
FIG. 4A is a horizontal cross-sectional view of a differential-common mode resonant filter according to still another exemplary embodiment of the present invention.
Figure 4B:
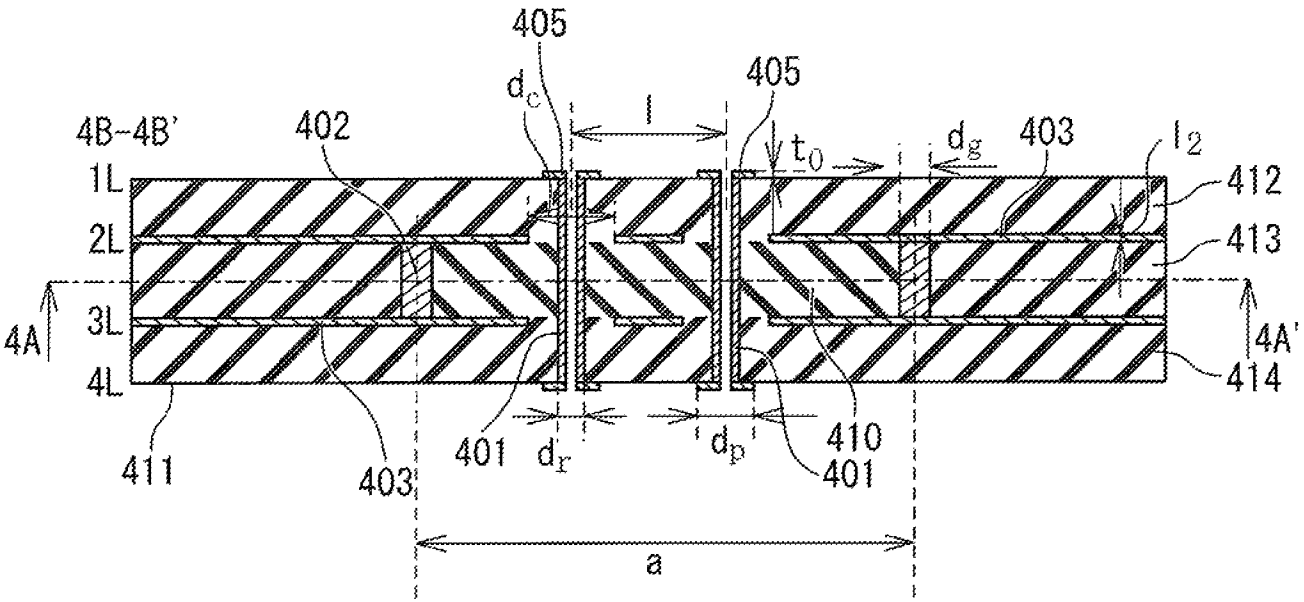
FIG. 4B is a vertical cross-sectional view of the filter passing on the face 4B-4B' as shown in FIG. 4A.
Figure 4C:
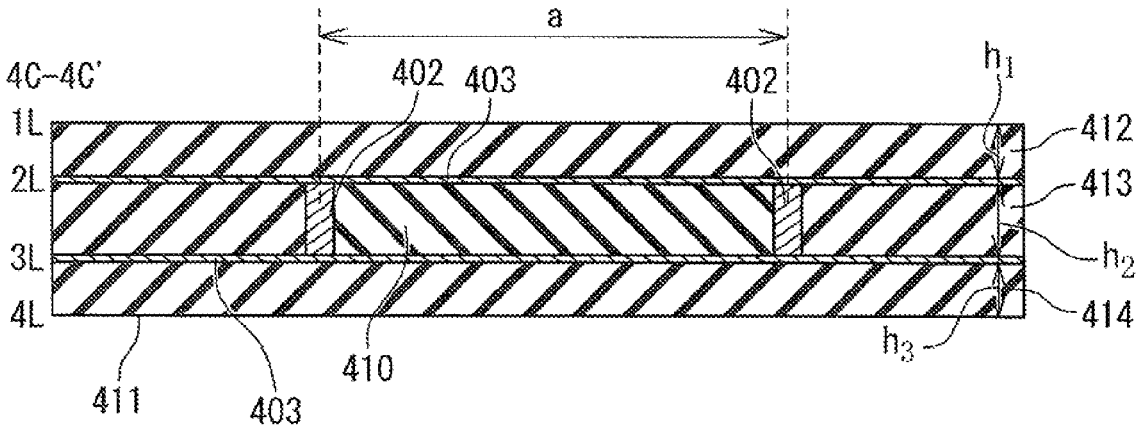
FIG. 4C is a vertical cross-sectional view of the filter on the face 4C-4C' as shown in FIG. 4A.
Figure 4D:
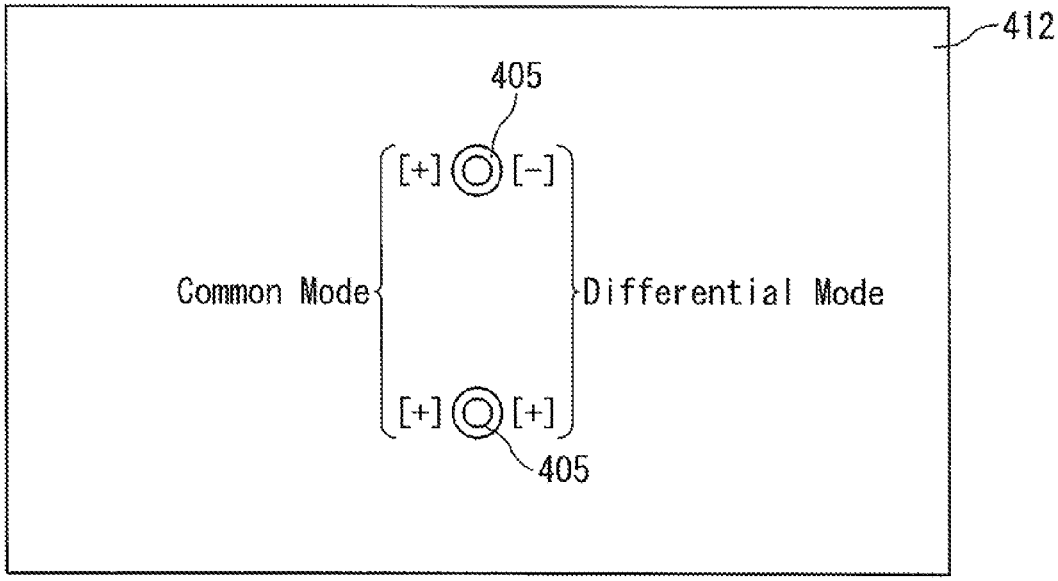
FIG. 4D is a top view of the filter.

In FIG. 3, simulation data as the insertion loss ($|S_{21}|$-parameter) for the filter shown in FIGS. 2A-2E having above-mentioned parameters are demonstrated. These results are obtained by the use of the finite-difference time-domain method which is well-established and one of the most accurate numerical methods.

As follows from the presented data, the structure demonstrates clearly-expressed properties of the differential-common mode filter. Moreover, it is important to note that stopbands for differential mode are in different positions if they are compared with common mode stopbands. As for an example, at the frequency about of 4.2 GHz, the common mode has a stopband; however, at this frequency, the differential mode passes through the filter without insertion loss practically. On the contrary, at the frequency about 7.9 GHz, the differential mode has a clearly-expressed stopband, but at the same time the common mode is propagating through the filter with a very small loss at this frequency. This is a distinguishing property of the proposed differential-common mode filter of the present exemplary embodiment.

Consider physical mechanisms lying in the basis of the differential-common mode filter using the structure shown in FIGS. 2A-2E. The electromagnetic field in the position of each signal via 201 within the resonator 210 as $(x_1, y_1)$ and $(x_2, y_1)$ can be approximately represented by following equations:

$$E(1) \sim E_0^{mnp} \cdot \sin\left(\frac{m\pi x_1}{a}\right) \cdot \sin\left(\frac{n\pi y_1}{b}\right) \cdot \cos\left(\frac{p\pi z}{h}\right) z, \tag{1a}$$

$$E(2) \sim E_0^{mnp} \cdot \sin\left(\frac{m\pi x_2}{a}\right) \cdot \sin\left(\frac{n\pi y_1}{b}\right) \cdot \cos\left(\frac{p\pi z}{h}\right) z, \tag{1b}$$

where m, n, and p give the order of the resonant mode; a and b are the side horizontal dimensions of the resonator210; E(1) is the electric field at the signal via 201 positioned at $(x_1, y_1)$, and E(2) is the electric field at the signal via 201 positioned at $(x_2, y_1)$; $E_0^{mnp}$ is the amplitude of the resonant mode; z is the unit vector of the direction which is perpendicular to the top and bottom ground plates 203 of the resonator 210. It is important to note that frequency $f_{mnp}$ of the resonant mode can be approximately expressed as:

$$f_{mnp} \approx \frac{c}{2\pi \cdot \sqrt{\mu\varepsilon}} \left[\left(\frac{m\pi}{a}\right)^2 + \left(\frac{n\pi}{b}\right)^2 + \left(\frac{p\pi}{h}\right)^2\right]^{1/2}, \tag{2}$$

where c is the velocity of light.

The electromagnetic field of the differential mode at the output of the filter will be proportional to the difference of the fields at the signal vias 201, that is:

$$E_d^{mnp} \sim (E(1) - E(2)). \tag{3}$$

At the same time, the electromagnetic field of the common mode at the output of the filter will be proportional to the sum of the field at the signal vias 201 and can be written as:

$$E_d^{mnp} \sim (E(1) - E(2)). \tag{4}$$

To provide the separation of the differential and common modes, positions of the signal vias 201 are chosen symmetrically with respect to the vertical face of symmetry passing between the signal vias 201. It means that $x_2 = a - x_1$. In this case, Eq. (1b) can be written as:

$$E(2) \sim -E_0^{mnp} \cdot \sin\left(\frac{m\pi x_1}{a}\right) \cdot \sin\left(\frac{n\pi y_1}{b}\right) \cdot \cos\left(\frac{p\pi z}{h}\right) \cdot \cos(m\pi) \cdot z, \tag{5}$$

As a result, according to Eq. (3) and taking into account Eqs. (1a) and (5), the electromagnetic field $E_d^{mnp}$ for the differential mode can be represented as following:

$$E_d^{mnp} \sim E_0^{mnp} \cdot \sin\left(\frac{m\pi x_1}{a}\right) \cdot \sin\left(\frac{n\pi y_1}{b}\right) \cdot \cos\left(\frac{p\pi z}{h}\right) \cdot (1 + \cos m\pi) \cdot z, \tag{6}$$

Defined by the similar manner, the electromagnetic field $E_c^{mnp}$ of the common mode can be obtained as:

$$E_c^{mnp} \sim E_0^{mnp} \cdot \sin\left(\frac{m\pi x_1}{a}\right) \cdot \sin\left(\frac{n\pi y_1}{b}\right) \cdot \cos\left(\frac{p\pi z}{h}\right) \cdot (1 + \cos m\pi) \cdot z, \tag{7}$$

Thus, as follows from Eqs. (6) and (7), the differential resonant modes of some orders will be canceled that give the propagation of the differential mode of these orders through the resonator 210 without losses, practically. But simultaneously, the common resonant modes having the same orders will be resonating that will lead to a dramatic increase of the losses and forming the stopbands for the common mode at the orders. Also for other orders of resonances, the stopbands will be formed for the differential mode but the common mode will be propagating through the resonator 210 with insignificant losses.

As for example, consider FIG. 3 in which insertion losses are presented for the differential and common modes.

The electromagnetic field of the lowest differential mode can be represented by following expression:

$$E_d^{110} \sim E_0^{110} \cdot \sin\left(\frac{\pi x_1}{a}\right) \cdot \sin\left(\frac{\pi y_1}{b}\right) \cdot (1 + \cos\pi) \cdot z = 0. \tag{8}$$

Eq. (8) means that the differential mode is propagating through the resonator 210 without losses at the resonant frequency of 4.2 GHz which can be also defined according to Eq. (2).

At the same time, the electromagnetic field for the common mode can be obtained as:

$$E_c^{110} \sim E_0^{110} \cdot \sin\left(\frac{\pi x_1}{a}\right) \cdot \sin\left(\frac{\pi y_1}{b}\right) \cdot (1 - \cos\pi) \cdot z = 2 \cdot E_0^{110} \cdot \sin\left(\frac{\pi x_1}{a}\right) \cdot \sin\left(\frac{\pi y_1}{b}\right). \tag{9}$$

As follows from Eq. (9), the common mode is resonating and for this mode the stopband is formed around frequency of 4.2 GHz that is agreed with FIG. 3.

At the frequency about 7.9 GHz, the differential mode has a stopband, but simultaneously the common mode is propagating through the resonator. It can be also explained by Eqs. (6) and (7).

This is a distinguishing property of the filter of the present exemplary embodiment. Thus, the filter of the present exemplary embodiment effectively achieves cancellation of one group of resonances for one mode (differential or common) that give the propagation of this mode through the filter at these resonances. At the same time, another mode (common or differential, respectively) will be resonating at these frequencies that lead to forming stopbands at considered frequencies.

Therefore, the separation of the differential and common modes can be obtained in frequency domain.

This is a basis of forming the band pass filter for the differential mode providing band stop characteristics for the common mode at the same time and vice versa.

Thus, a number of filters can be obtained by the use of the proposed approach including a resonator in a multilayer board having a vertical face of symmetry and a pair of signals vias disposed symmetrically with respect to this face.

A number of resonators with different arrangements of ground vias forming side walls can be developed. Note such arrangement can be used to control the frequency response of the filter.

In FIGS. 4A-4D, a differential-common mode resonant filter with a square arrangement of ground vias 402 in side walls of a resonator 410 is presented. This filter is formed by a pair of signal vias 401 embedded in the resonator 410 and connected to terminals 405 disposed on the top and bottom conductor layers 1L and 4L of a four-conductor-layer board 411 including three isolation substrates 412 to 414.

Figure 5:
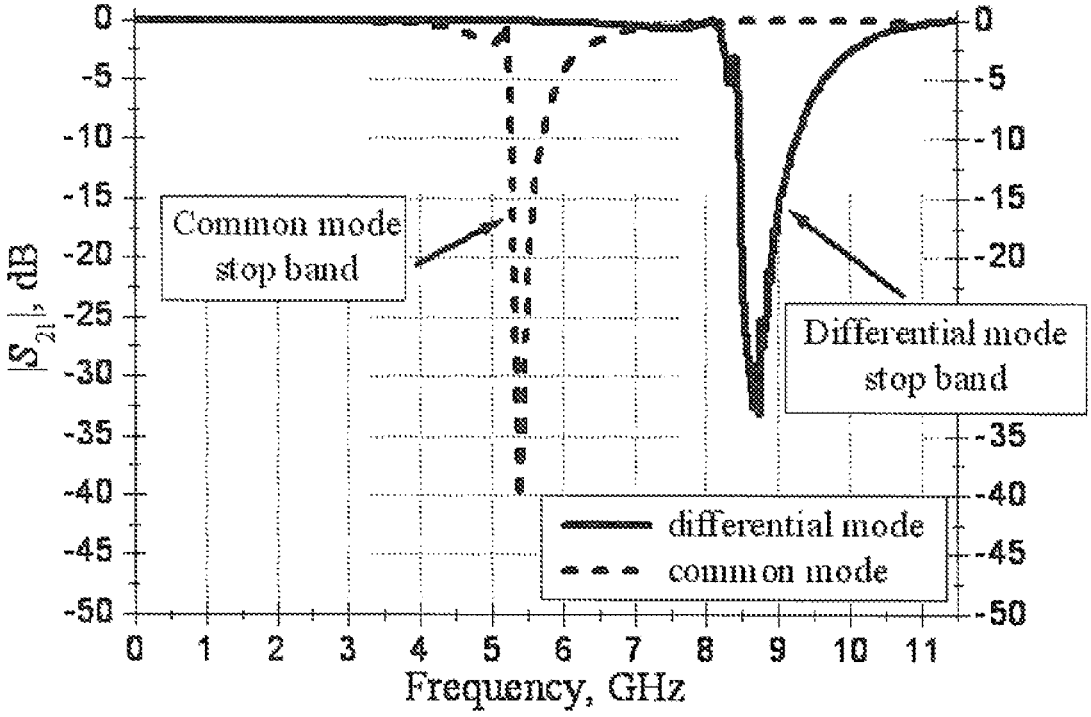
FIG. 5 is a graph illustrating insertion losses of the differential-common mode resonant filter with square arrangement of side walls.
Figure 6A:
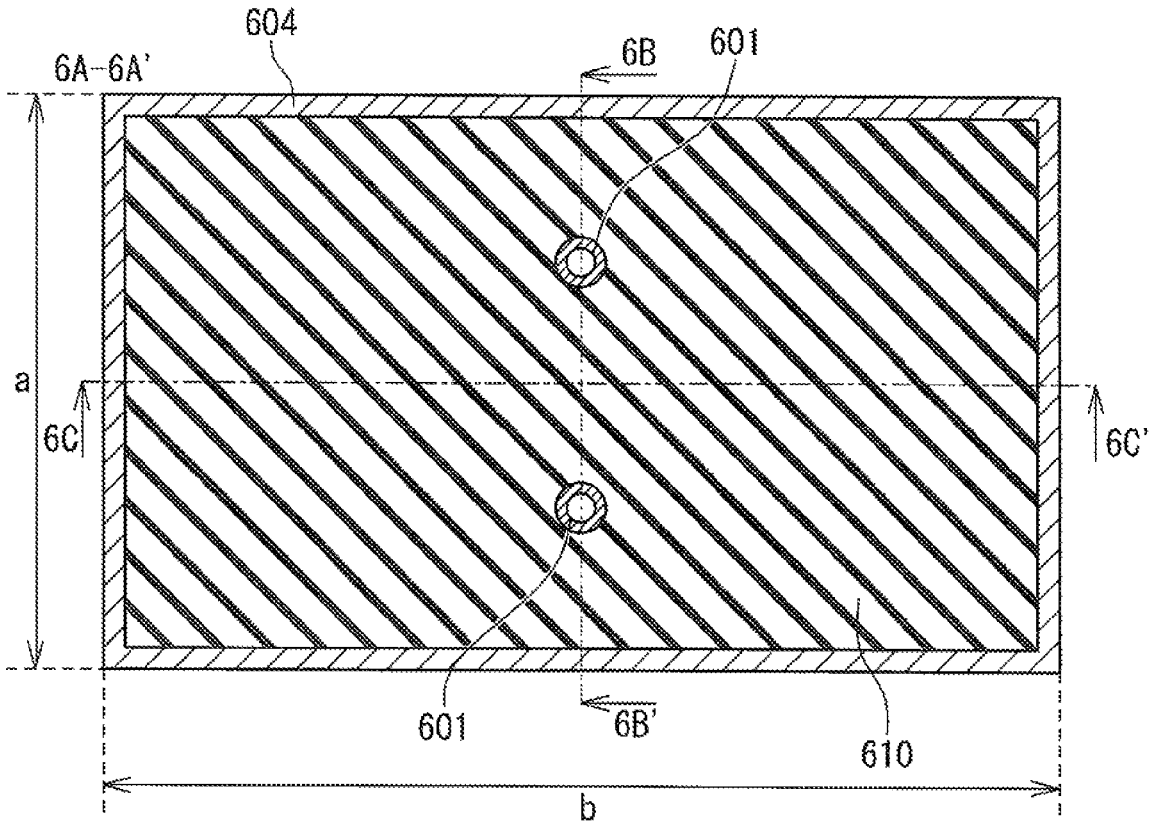
FIG. 6A is a horizontal cross-sectional view of a differential-common mode resonant filter according to still another exemplary embodiment of the present invention.
Figure 6B:
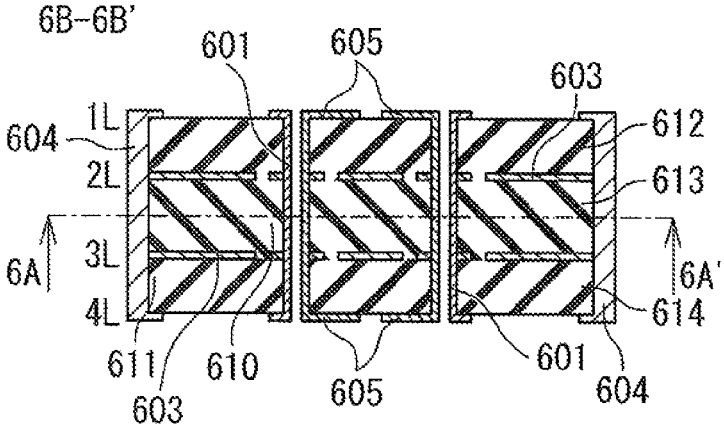
FIG. 6B is a vertical cross-sectional view of the filter on the face 6B-6B' as shown in FIG. 6A.
Figure 6C:
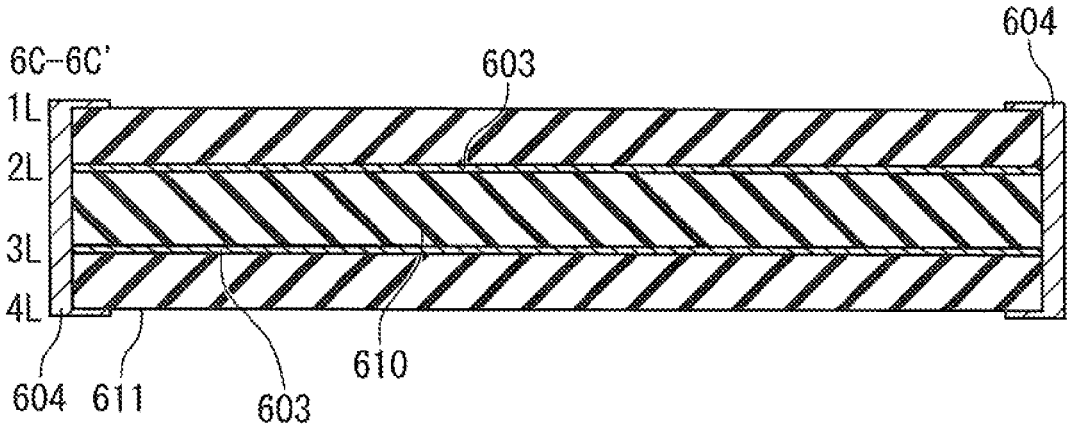
FIG. 6C is a vertical cross-sectional view of the filter on the face 6C-6C' as shown in FIG. 6A.
Figure 6D:
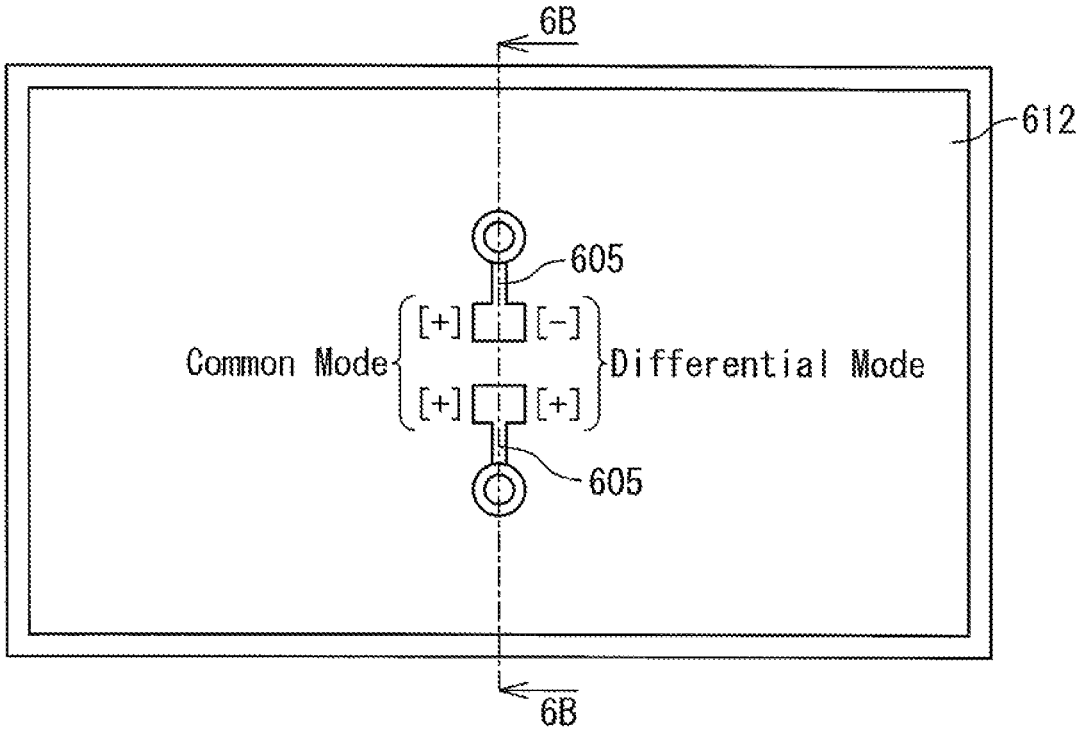
FIG. 6D is a top view of the filter.
Figure 7A:
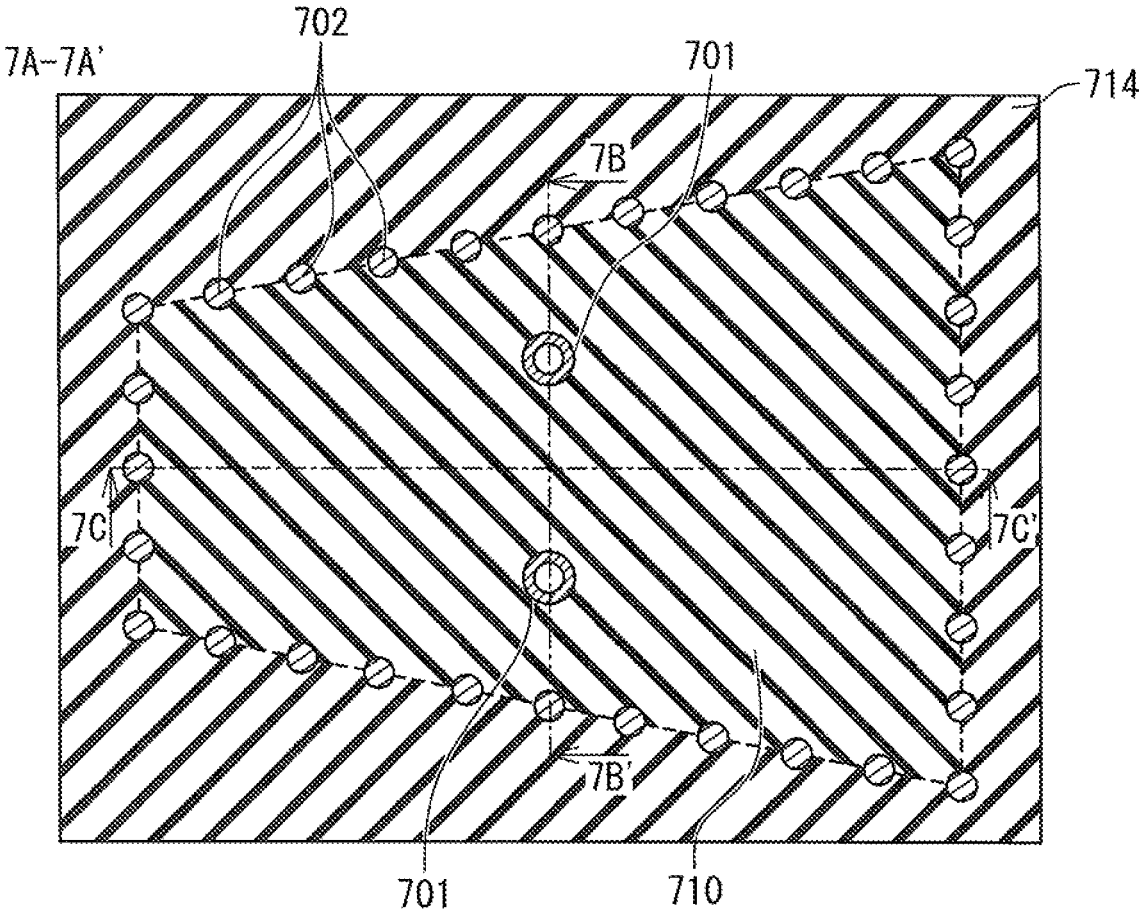
FIG. 7A is a horizontal cross-sectional view of a differential-common mode resonant filter according to still another exemplary embodiment of the present invention.
Figure 7B:
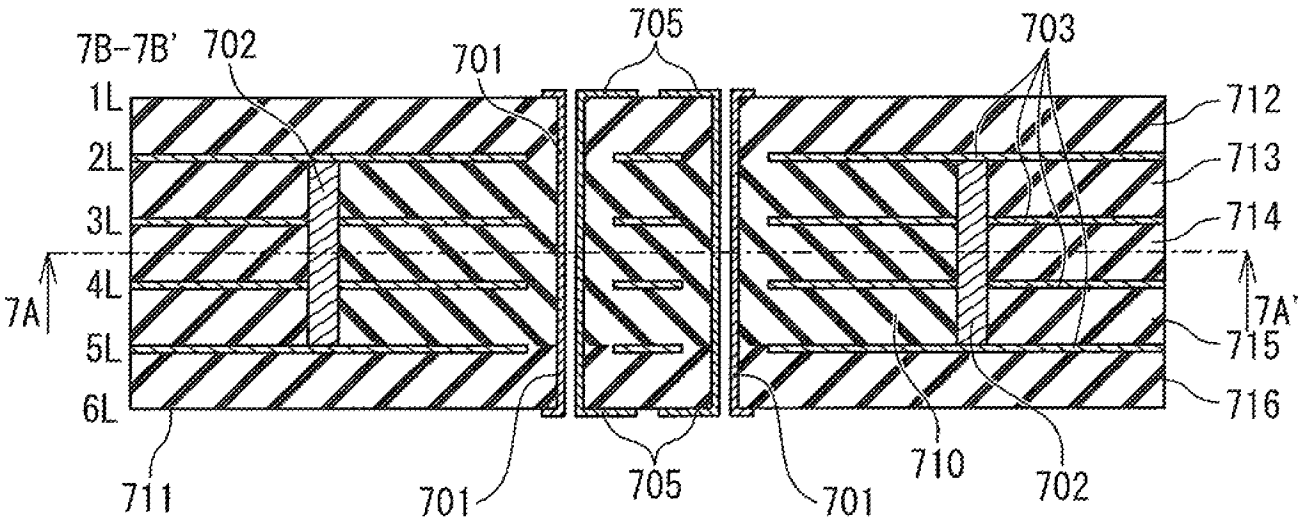
FIG. 7B is a vertical cross-sectional view of the filter on the face 7B-7B' as shown in FIG. 7A.
Figure 7C:
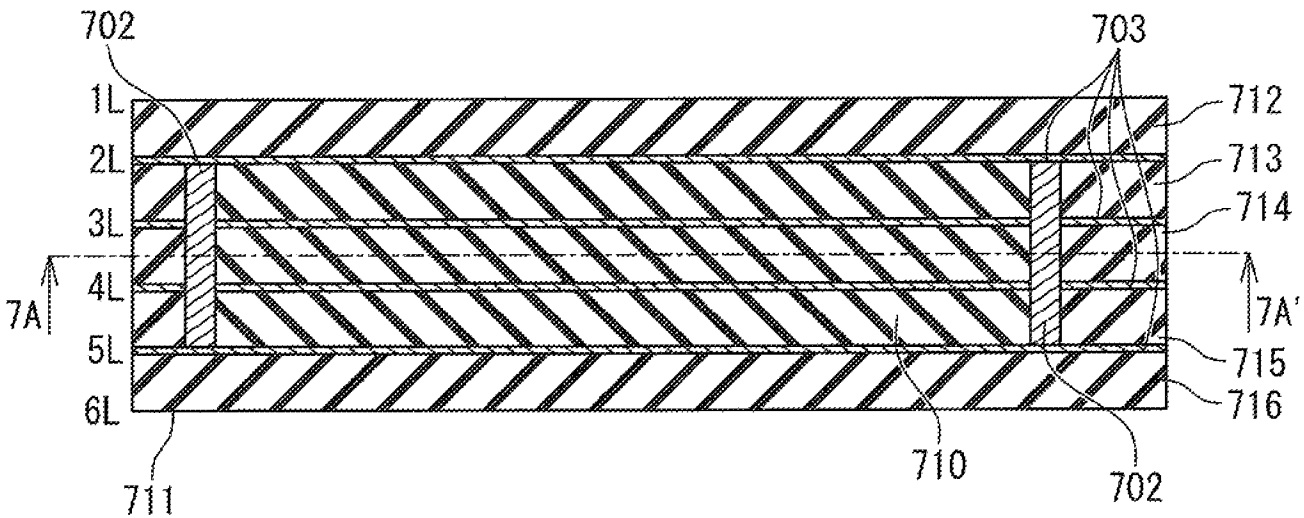
FIG. 7C is a vertical cross-sectional view of the filter on the face 7C-7C' as shown in FIG. 7A.
Figure 7D:
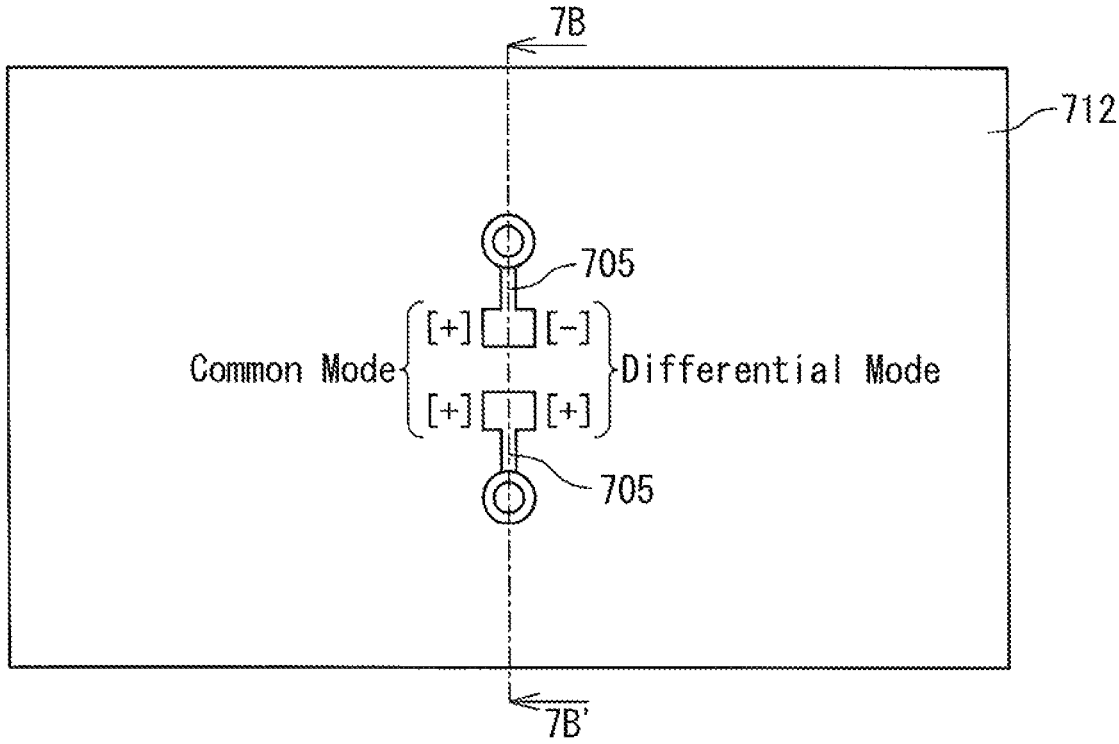
FIG. 7D is a top view of the filter.
Figure 8A:
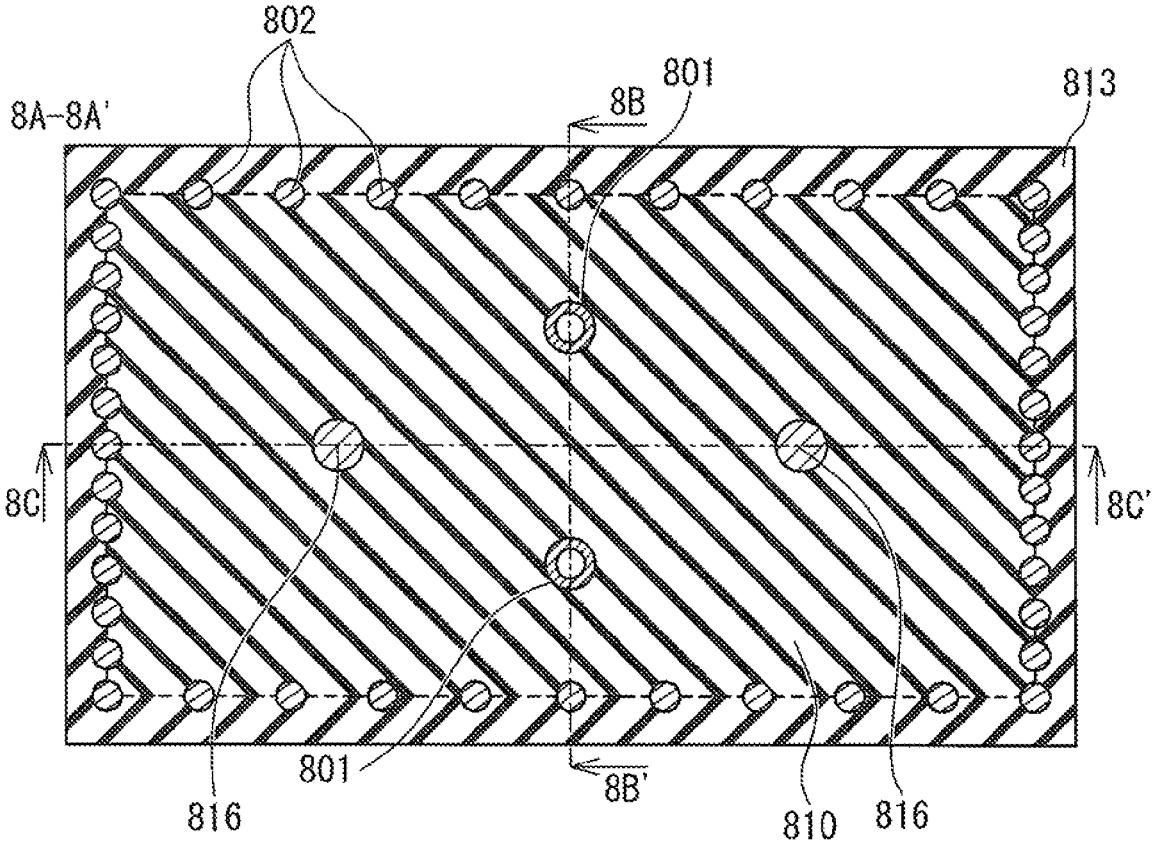
FIG. 8A is a horizontal cross-sectional view of a differential-common mode resonant filter according to still another exemplary embodiment of the present invention.
Figure 8B:
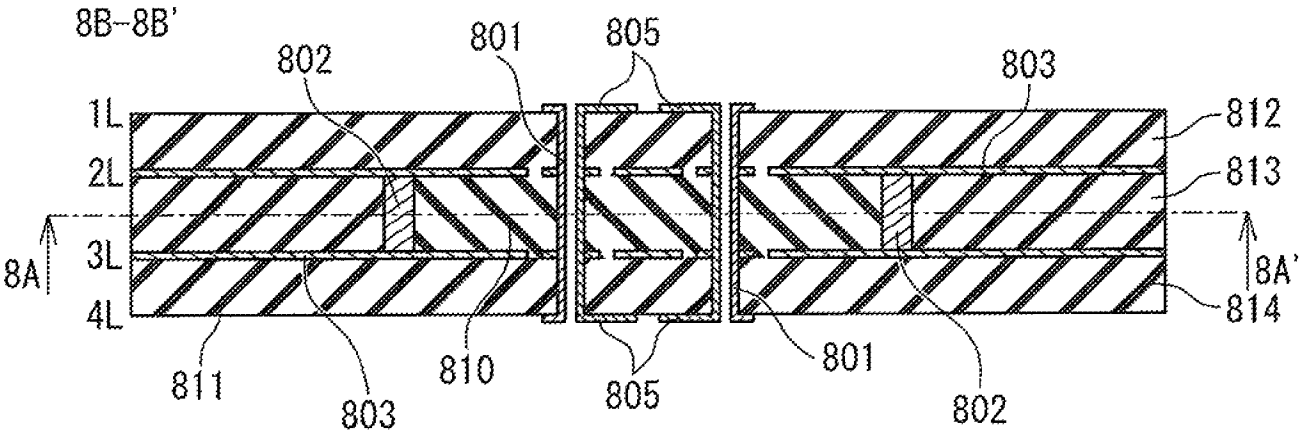
FIG. 8B is a vertical cross-sectional view of the filter on the face 8B-8B' as shown in FIG. 8A.
Figure 8C:
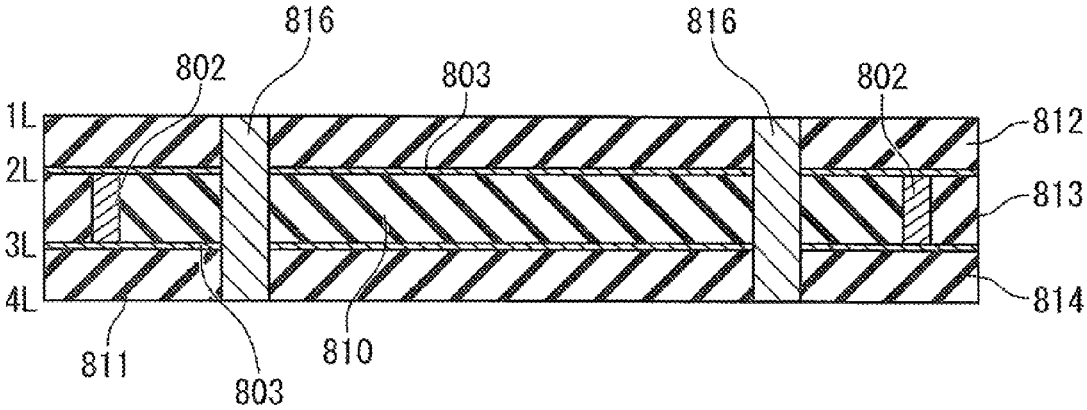
FIG. 8C is a vertical cross-sectional view of the filter on the face 8C-8C' as shown in FIG. 8A.
Figure 8D:
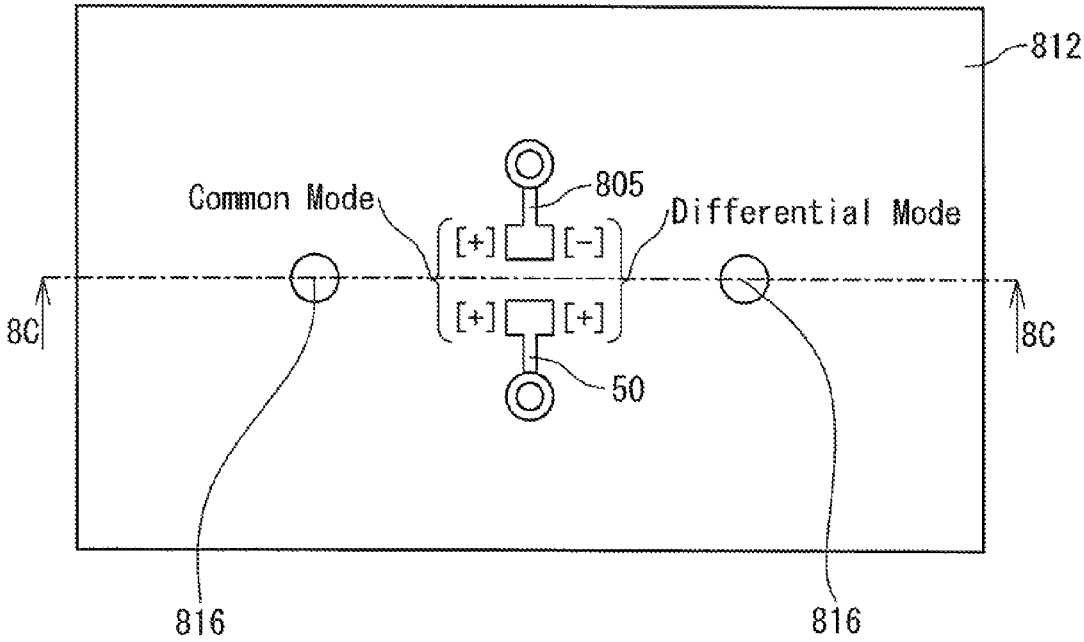
FIG. 8D is a top view of the filter.
Figure 9A:
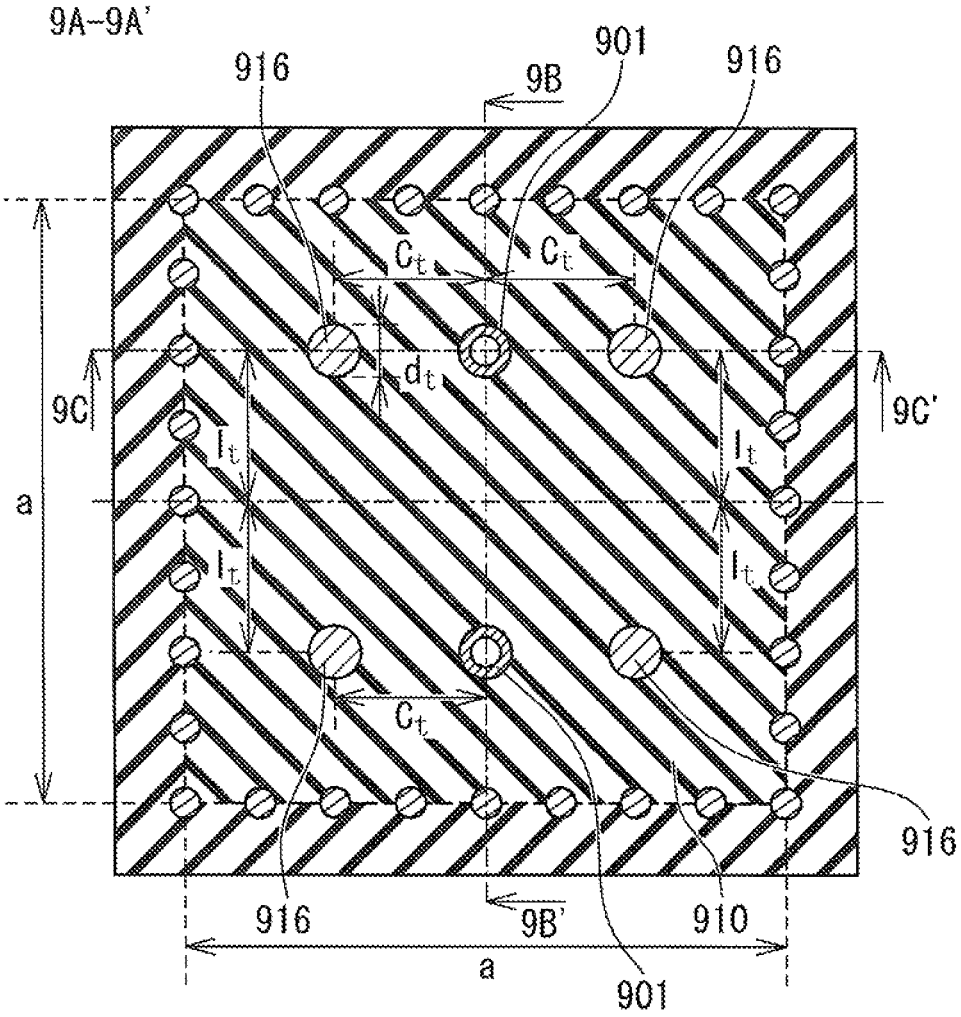
FIG. 9A is a horizontal cross-sectional view of a differential-common mode resonant filter according to still another exemplary embodiment of the present invention.
Figure 9B:
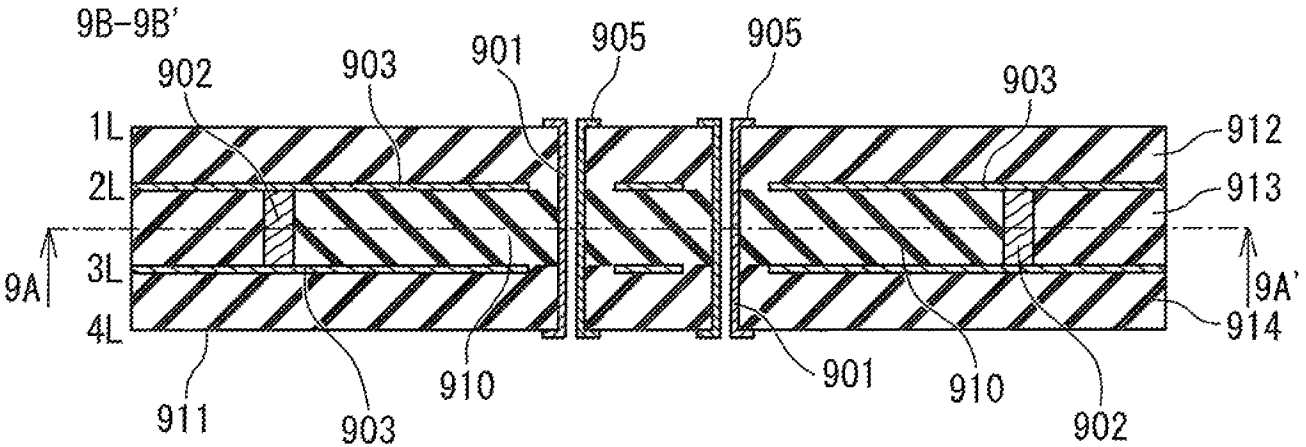
FIG. 9B is a vertical cross-sectional view of the filter on the face 9B-9B' as shown in FIG. 9A.
Figure 9C:
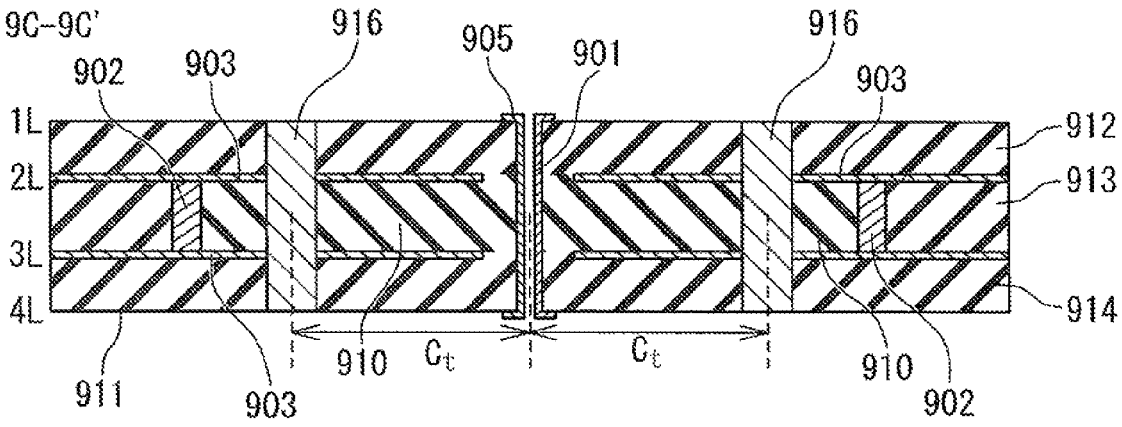
FIG. 9C is a vertical cross-sectional view of the filter on the face 9C-9C' as shown in FIG. 9A.
Figure 9D:
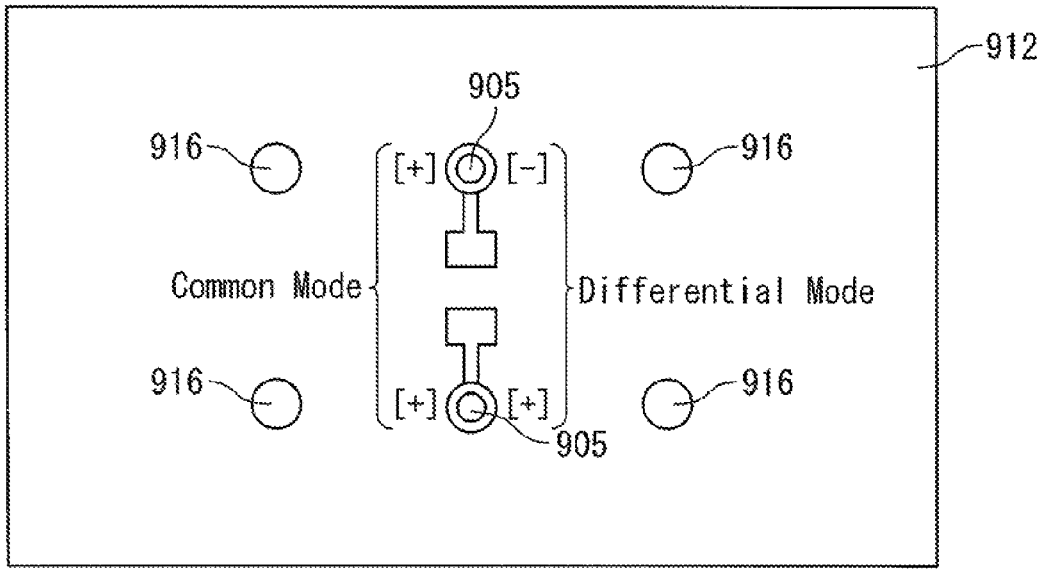
FIG. 9D is a top view of the filter.

In FIG. 5, the numerical example is presented for structure shown in FIGS. 4A-4D. Dimensions of the four-conductor-layer board 411, the signal vias 401, and the resonator 410 are the same as for FIG. 3, but only the resonator 410 is as a square one with the side of a=20 mm. As follows from simulation results, this type of filters also demonstrate separation of the differential and common modes for which the stopband is in different positions (for common mode, the central frequency of the stopband is about 5.3 GHz, but for differential mode this frequency is about 8.7 GHz). Also, these data show that form of arrangement of ground vias in side walls (this form can be simple one like circular, elliptical, or more complicate one which is dictated by a concrete application) is effective approach to control frequency response.

It is important to emphasize that proposed filters can be used not only as integrated elements for in-board applications and also as independent devices.

In FIGS. 6A-6D, a differential common mode filter is presented. In this exemplary embodiment, side conductor plates 604 are used instead of ground vias to form the side walls of a resonator 610.

More specifically, this resonator 610 is formed by ground planes 603 formed within a four-conductor-layer board 611 incorporating three isolation substrates 612 to 614 and side conductor plates 604 formed on the sides of the four-conductor-layer board 611. Signal vias 601 disposed symmetrically with respect to the vertical face 6C-6C' are connected to terminals 605 at the top and bottom conductor layers 1L and 4L of the four-conductor-layer board 611. Such type of differential-common resonant filters is applicable as an independent device.

Although the filters in the aforementioned exemplary embodiments have two faces of symmetry, it is well-understandable that providing the separation of the differential and common modes can be achieved in a differential-common mode resonant filter with a resonator having one face of symmetry in which signal vias will be disposed symmetrically with respect to this face. In FIGS. 7A-7D, another exemplary embodiment of the differential-common mode resonant filter is presented. This filter is provided with signal vias 701, a resonator 710 and terminals 705 which are placed on top and bottom conductor layers 1L and 6L of a multilayer board 711 incorporating five isolation substrates 712 to 716. The resonator 710 is formed by ground vias 702 connected to ground planes 703 and arranged in such way that a trapezoidal contour of side walls is obtained. In this structure, signal vias 701 are symmetrical with respect to the face 7C-7C'.

In another exemplary embodiment of the present invention, a differential-common resonant filter may incorporate tuning elements embedded in the resonator. Such filters can not only provide the shift of the stopband but also widening of the stopband.

In FIGS. 8A-8D, a differential-common resonant filter with two tuning elements is shown. This filter is provided with two signal vias 801 embedded in a resonator 810 and connected to terminals 805. The resonator 810 is formed by ground planes 803 and ground via walls 802 connected to these ground planes. The filter is based on a four-conductor-layer board 811 incorporating three isolation substrates 812 to 814. As a distinguishing characteristic of this filter, tuning elements 816 are embedded in the resonator 810. These tuning elements 816 are disposed through the resonator 810, affecting on the position and the Q-factor of the resonances. In the shown exemplary embodiment, the tuning elements 816 are disposed symmetrically with respect to the signal vias 801 to provide the same effect on the signal vias 801.

The tuning elements 816 may be made of material to give a required property of the filter. This material may be metal, dielectric, or electromagnetic wave absorbing material (for example, ferrite). It should be noted that the tuning elements 816 may be formed in forms of hollow tubes instead of solid structures; the tuning elements 816 may be formed as metallizations formed on the side walls of holes passing through the resonator 810. Also, the number and dimensions of tuning elements 816 may be modified to achieve the required property.

In FIGS. 9A-9D, a differential-common mode filter with four tuning elements 916 is presented. This filter is provided with a multilayer board 911 including three isolation substrates 912 to 914. Formed within the multilayer board 911 is a resonator 910 with a square arrangement of ground vias 902 connected to ground planes 903. The ground vias 902 form side walls of the resonator 910. Within the resonator 910, signal vias 901 are embedded.

To demonstrate the effect of the tuning elements 916 on the electrical performance of the filter, the structure and dimensions of the filter and board material are chosen the same as in numerical example shown in FIG. 5. The four same tuning elements 916 are disposed symmetrically with respect to the signal vias 901 with following dimensions according to notation of FIGS. 9A-9D. Thus, $d_t$=2 mm; $l_t$=5 mm; and $c_t$=5 mm.

Figure 10A:
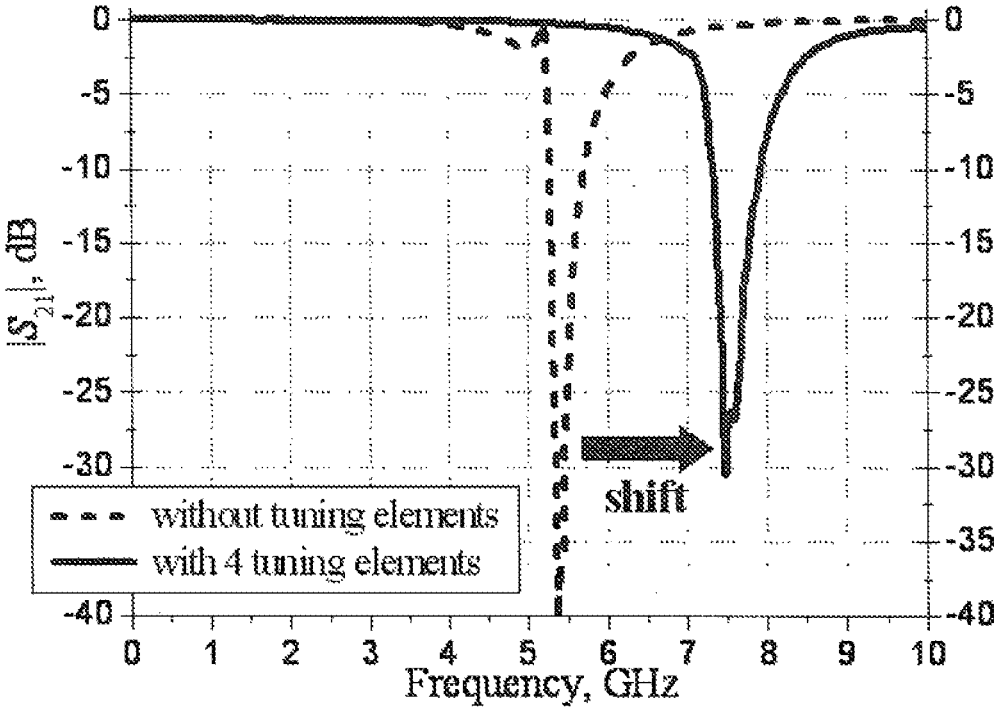
FIG. 10A illustrates the insertion loss of the common mode for the filter shown in FIGS. 9A-9D with four metallic tuning elements.

In FIG. 10A, the insertion loss of the common mode for the filter shown in FIGS. 9A-9D with four metallic tuning elements 916 is presented. Also, the insertion loss of the same filter but without tuning elements is demonstrated for comparison in this figure. As follows from the presented data, the application of four metallic tuning elements gives a shift of the resonance frequency to a higher value. This result can be explained by reduction of the effective horizontal dimensions of the resonator 910 which are responsible for the position of the resonance frequency.

Figure 10B:
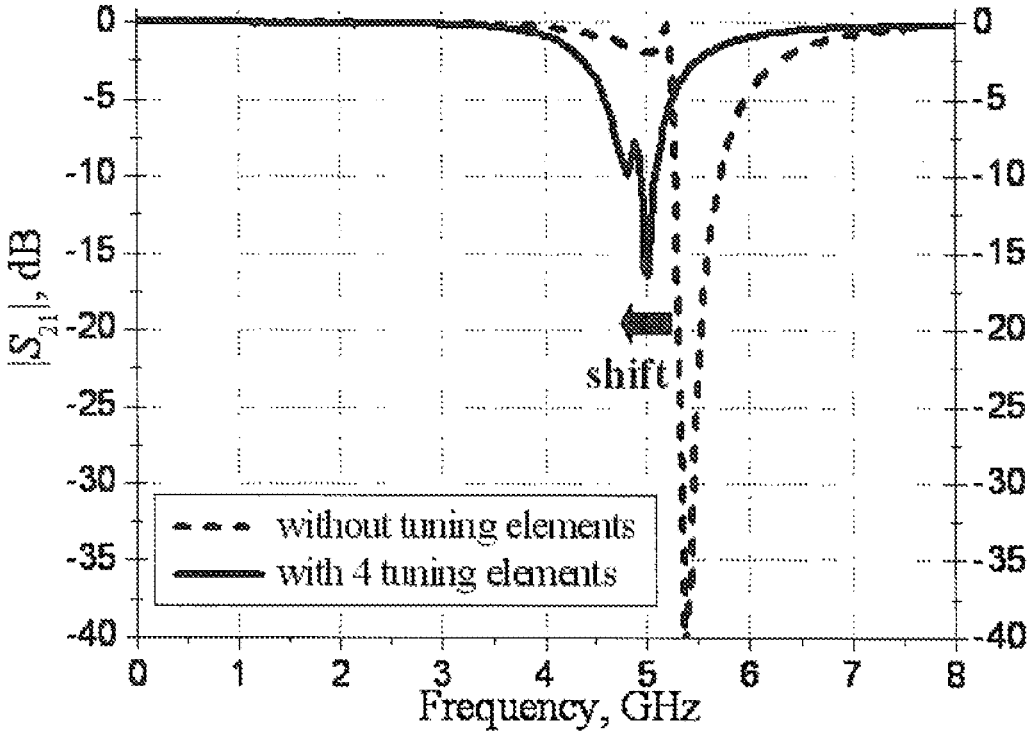
FIG. 10B illustrates the insertion loss of the common mode for the filter shown in FIGS. 9A-9D with four dielectric tuning elements.
Figure 11A:
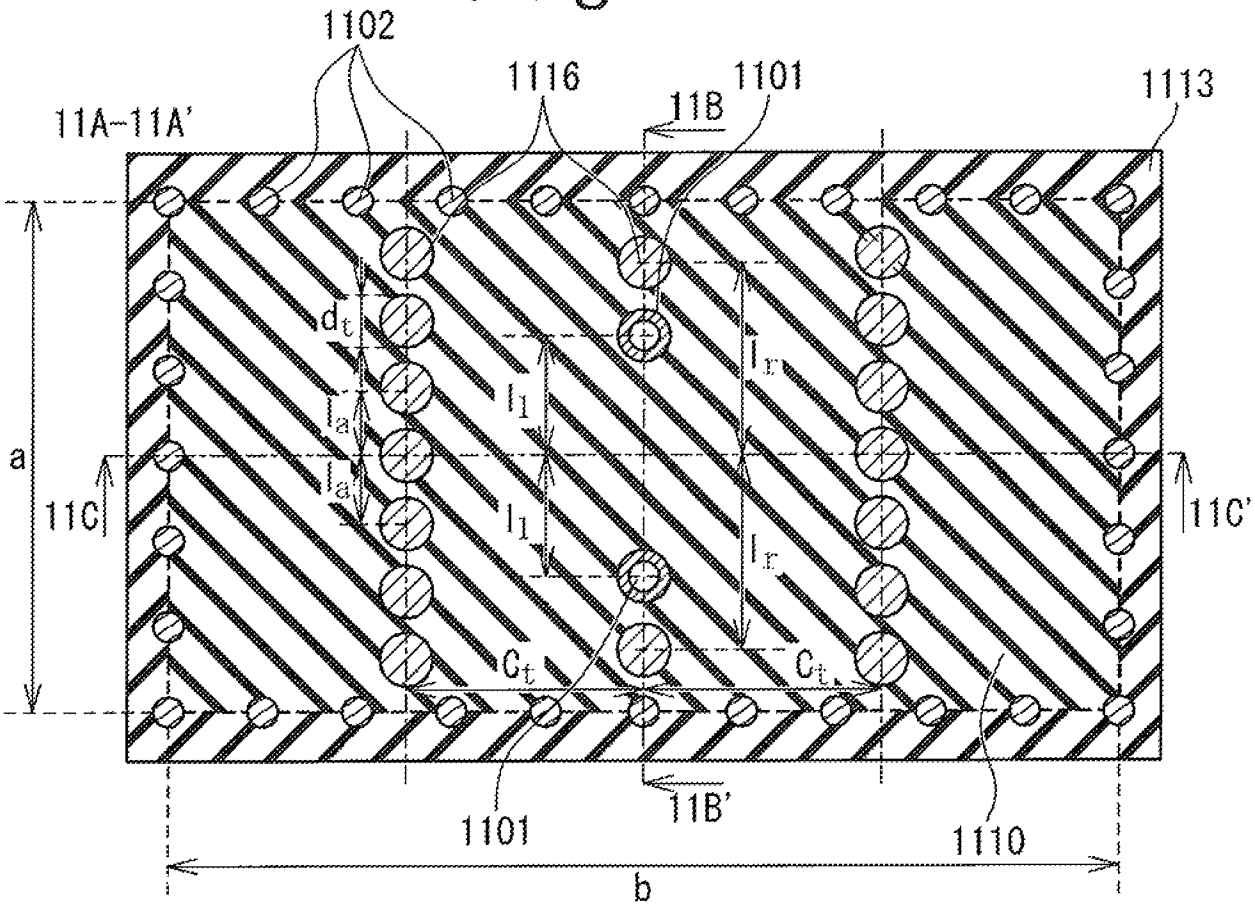
FIG. 11A is a horizontal cross-sectional view of a differential-common mode resonant filter according to still another exemplary embodiment of the present invention.
Figure 11B:
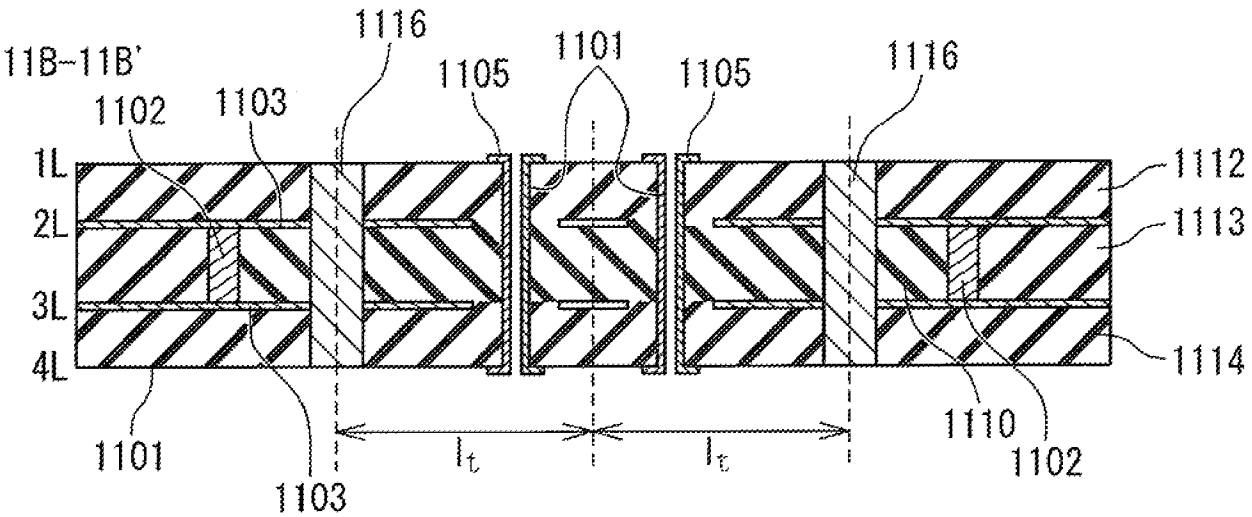
FIG. 11B is a vertical cross-sectional view of the filter on the face 11B-11B' as shown in FIG. 11A.
Figure 11C:
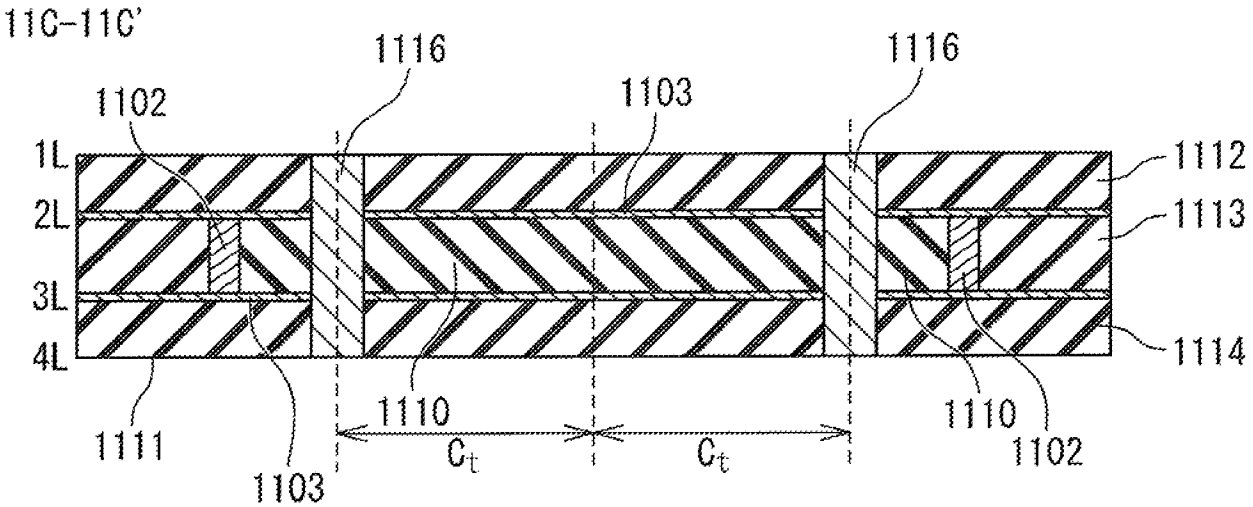
FIG. 11C is a vertical cross-sectional view of the filter on the face 11C-11C' as shown in FIG. 11A.
Figure 11D:
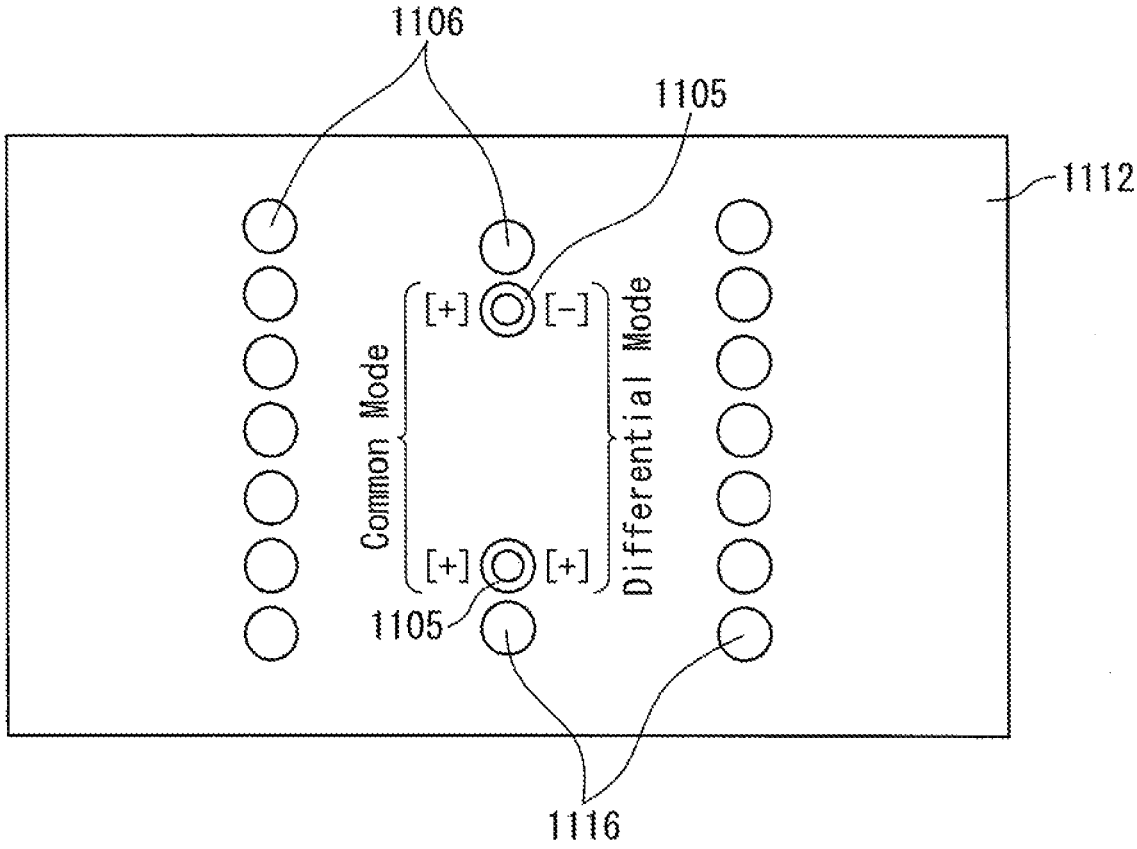
FIG. 11D is a top view of the filter.

In FIG. 10B, the insertion loss for the common mode of the filter with dielectric tuning elements 916 is shown. The structure and dimensions of the filter are the same as for FIG. 10A, but only the four tuning elements 916 are made of dielectric material with a relative permittivity of 40, instead of metal. It should be noted that the relative permittivity of the dielectric material of the tuning elements 916 is higher than that of the isolating material of the isolation substrate 912 to 914 within the multilayer board 911. As one can see in FIG. 10B, the use of the dielectric material with the higher permittivity than the isolating material of the multilayer board 911 leads to the shift of the resonance frequency to the lower frequency if it is compared with the same filter but without tuning elements. This property of the filter can be traced by considering Eq. (2).

The tuning elements 916, made of material for which the relative permittivity is higher than the board material permittivity, give higher effective permittivity of the resonator 910 and this, as a result, shifts the resonance frequency to a lower value.

Also, preferable properties of the differential-common mode resonant filter can be obtained by the use of electric absorbing material as the tuning elements 916. Introduction of such material in the resonator 910 of the filter can give widening the resonance line that can be explained by the following expression:

$$\frac{\Delta f}{f_0} \approx \tan\delta_{eff}, \tag{10}$$

where $\Delta f$ is the bandwidth, $f_0$ is the resonance frequency, and $\tan \delta_{eff}$ is the effective loss tangent of the composite material of the resonator 910 which is obtained from loss tangents of the tuning elements 916 and the materials of the multilayer board 911.

Taking into account distinctive properties of the differential and common modes and also using absorbing material in the tuning elements 916, a differential-common mode resonant filter with an increased frequency band of suppression of the common mode can be designed.

It should be noted that the electromagnetic field of the differential mode will be concentrated between signal vias if the distance between these vias will be small enough. At the same time, the electromagnetic field of the common mode for these signal vias will be extended to the side ground via walls of the resonator.

Applying tuning elements of electromagnetic wave absorbing material on a distance from the signal vias 901, suppressing the common mode can be obtained. It should be noted that simultaneously the differential mode will be propagating with a considerably lower loss. The distance on which the tuning elements 916 can be placed can be obtained by simulations in which step-by-step position and number of tuning elements 916 are changed for given electromagnetic wave absorbing material.

In FIGS. 11A-11D, still another exemplary embodiment of such filter is presented. The filter shown in FIGS. 11A-11D is provided with two signal vias 1101 which are connected to terminals 1105. These signal vias 1101 are embedded in a resonator 1110 which is formed in a multilayer board 1111 by ground plates 1103 and ground vias 1102 connected to the ground plates 1103. In this exemplary embodiment, the multilayer board 1111 is provided with three isolation substrates 1112 to 1114. A number of tuning elements 1116 are disposed in the resonator 1110 in the vicinity of signal vias 1101 to suppress the common mode in the wide frequency band.

Note that the resonator 1110 plays an important role in this filter because it increases considerably loss of the common mode propagating through the resonator 1110.

Consider a numerical implementation of the filter. In this implementation, the structure and dimensions of the filter are the same as for FIG. 3 but only the distance between the signal vias 1102 is 1=2 mm, and the number of the tuning elements 1116 is sixteen. These tuning elements 1116 are disposed symmetrically with respect to the signal vias 1101 as shown in FIGS. 11A-11D. The dimensions of the tuning elements 1116 are as follows: $d_t$=2 mm; $l_t$=5 mm; and $c_t$=5 mm.

As one can see in this numerical example, the distance between the signal vias 1101 is smaller compared with aforementioned numerical examples. This provides propagation of the differential mode through the resonator 1110 with a small effect of the resonator 1110 on this differential mode. It should be noted that the effect of the resonator 1110 on the common mode will be large in this case. In the present numerical example, the 16 tuning elements 1116 are filled with absorbing material with a relative permittivity $\epsilon$=40, the relative permeability $\mu$=1.2, the dielectric loss tangent tan $\delta$=0.26, and the magnetic loss tangent tan $\delta_m$=1.5.

Figure 12:
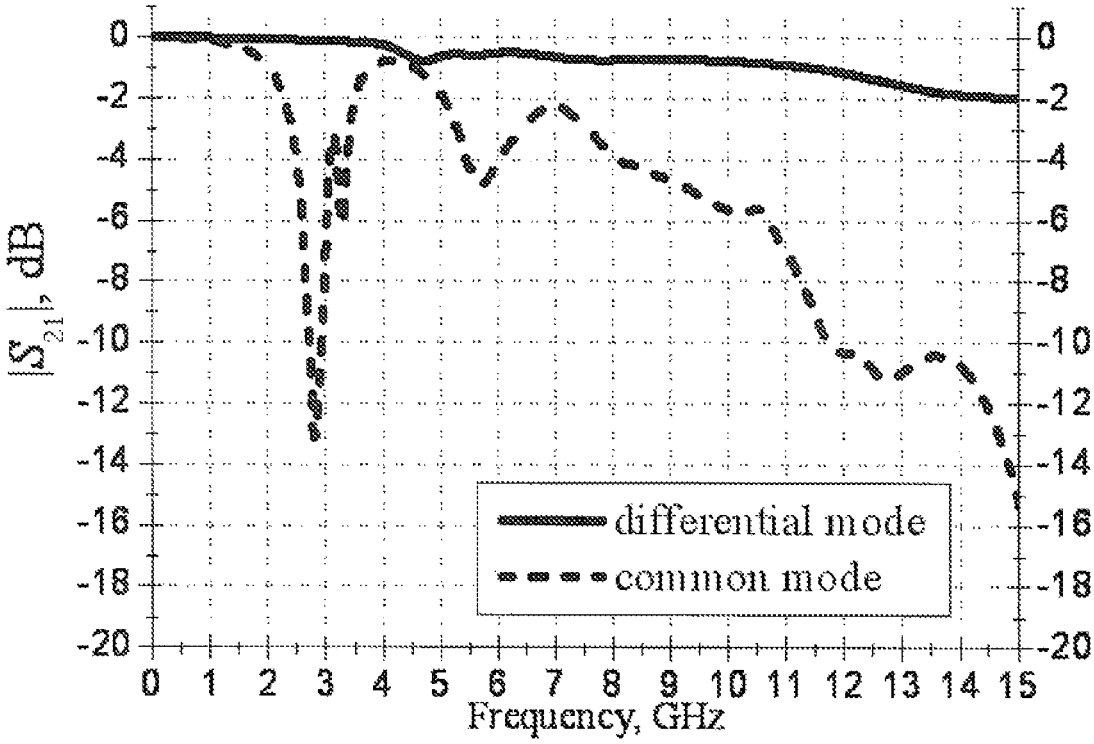
FIG. 12 illustrates the insertion losses of the differential and common modes for the filter shown in FIGS. 11A-1D with tuning elements made of electromagnetic wave absorbing material.
Figure 13A:
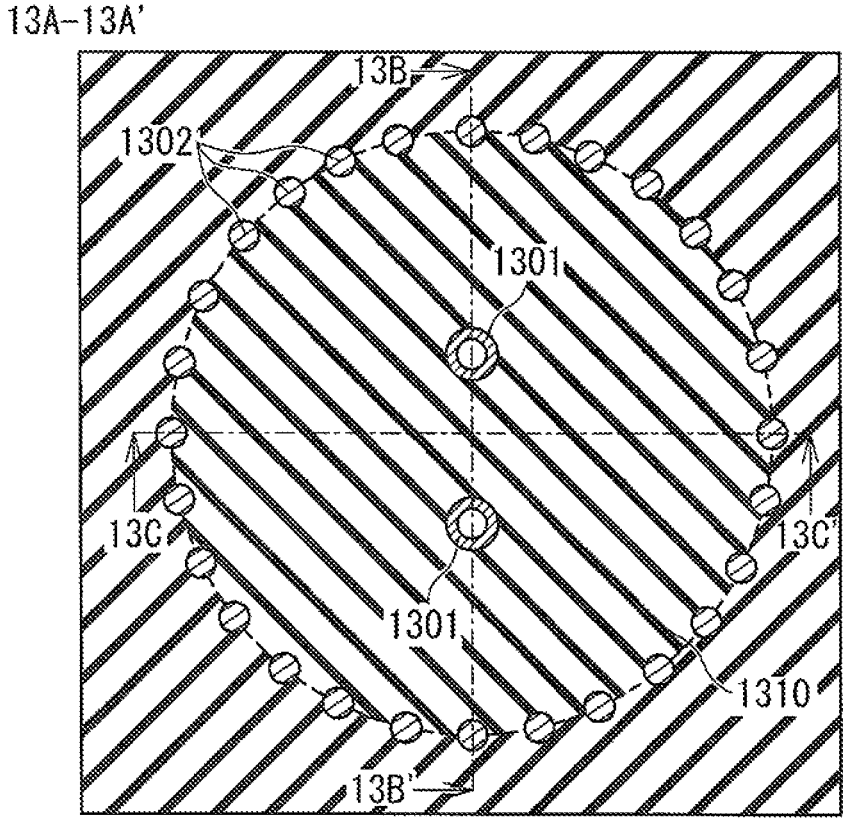
FIG. 13A is a horizontal cross-sectional view of a differential-common mode resonant filter according to still another exemplary embodiment of the present invention.
Figure 13B:
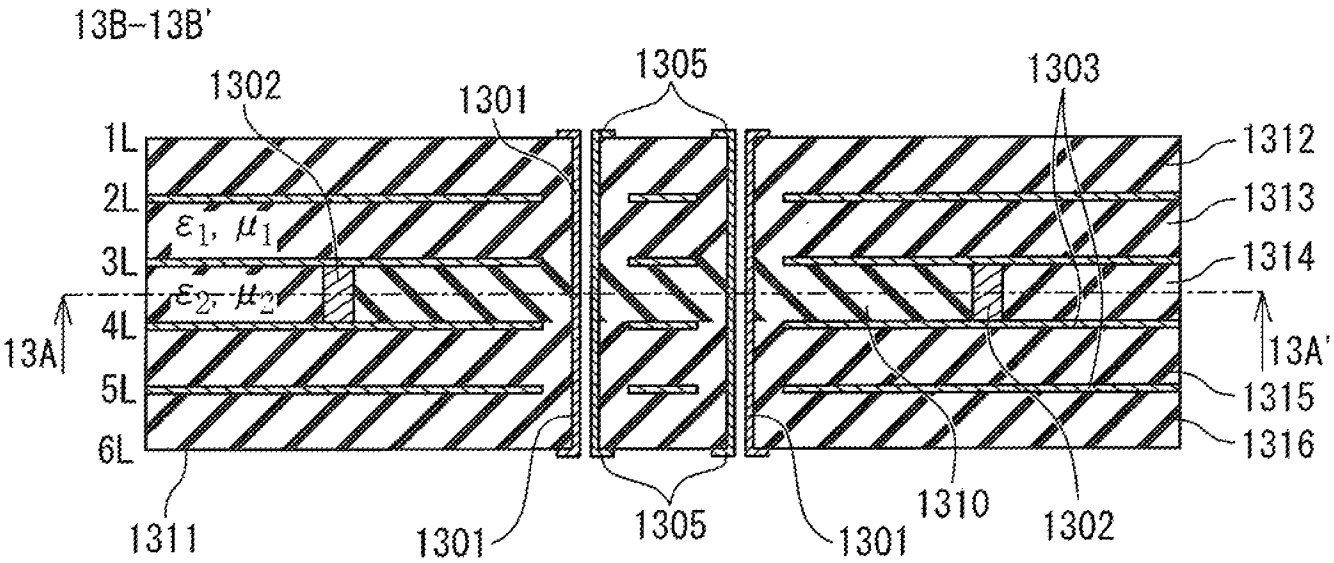
FIG. 13B is a vertical cross-sectional view of the filter on the face 13B-13B' as shown in FIG. 13A.
Figure 13C:
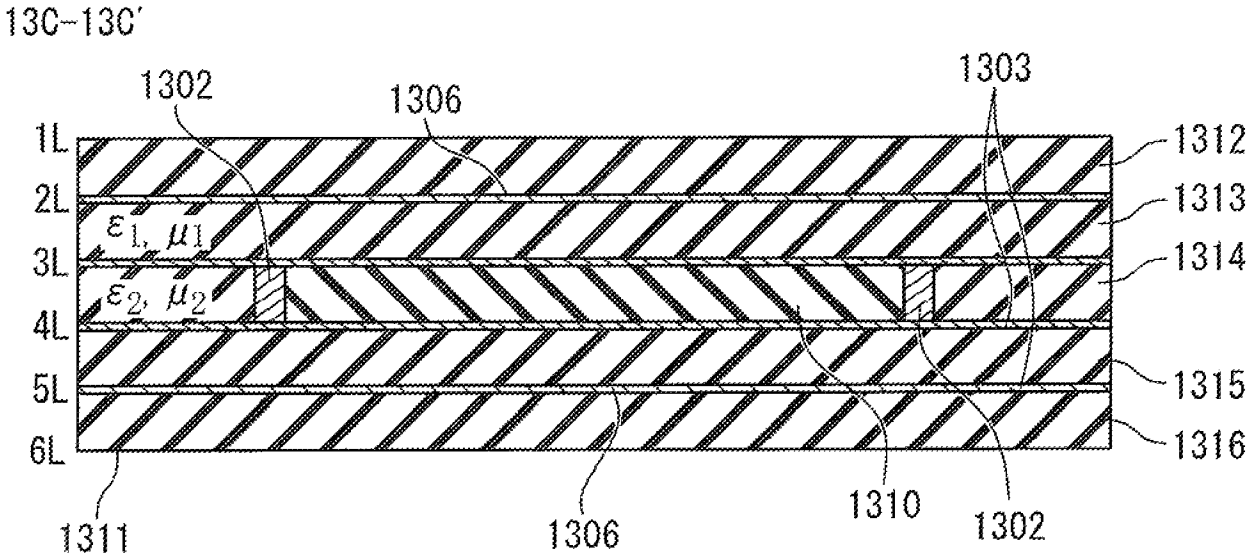
FIG. 13C is a vertical cross-sectional view of the filter on the face 13C-13C' as shown in FIG. 13A.
Figure 13D:
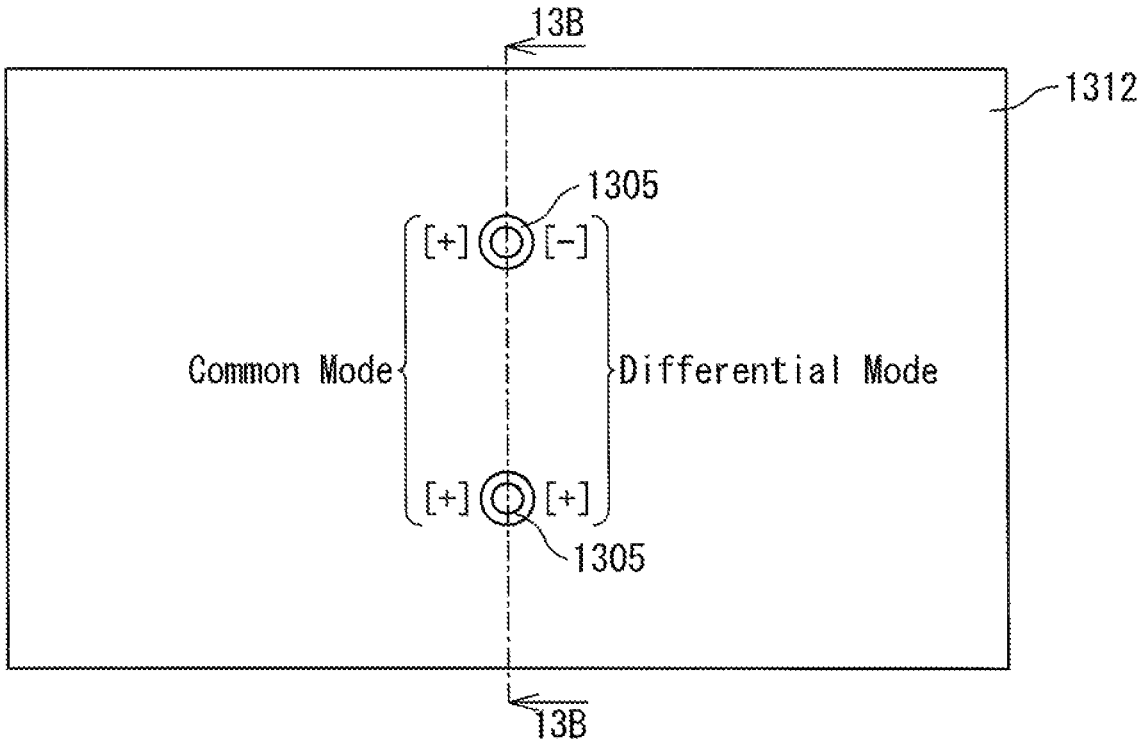
FIG. 13D is a top view of the filter.

In FIG. 12, simulated insertion losses for the differential and common modes are presented for the structure shown in FIG. 11A-11D. As shown in FIG. 12, in the frequency bands from about 2.3 GHz to about 3.7 GHz and also from about 8 GHz to 15 GHz, losses of the common mode are considerably higher than losses of the differential mode. This implies that in these frequency bands such structure suppresses effectively the common mode and has a small effect on the differential mode. This type of filters is especially important for digital applications.

It is important to emphasize that material filling in the resonator of the differential-common mode resonant filter can be used to define predetermined properties of this resonator.

It would be well-understandable that differential-common mode resonant filters may be formed in a multilayer board having a different number of ground plates. FIGS. 13A-13D show a differential-common mode resonant filter disposed within a six-conductor-layer board 1311 incorporating five isolation substrates 1312 to 1316, in still another exemplary embodiment of the present invention.

This filter is provided with two signal vias 1301 embedded in the six-conductor-layer board 1311. The signal vias 1301 are disposed within a resonator 1310 which is formed by ground vias 1302 and ground plates 1303. The ground vias 1302 are used as side walls of the resonator 1310. A distinguishing characteristic of this filter is a round arrangement of ground vias 1302. In this exemplary embodiment, any face vertical to the ground plates 1303 and passing through the center of the resonator 1310 will be a vertical face of symmetry. Such property of the round in-board resonator is useful if a predetermined orientation of the pair of the signal vias 1301 will be necessary, because in this resonator, any orientation of the pair of the signal vias 1301 disposed symmetrically with respect to the center of the resonator 1310 can provide the separation of the differential and common modes in the frequency domain.

In the filter shown in FIGS. 13A-13D, another important feature of the differential-common mode resonant filter is presented. In this exemplary embodiment, the material disposed between the ground plates 1303 forming the resonator 1310, which has a relative permittivity of $\epsilon_2$ and a relative permeability of $\mu_2$, is different from the material filled in the space between the ground plates 1303 and ground plates 1306, which has a relative permittivity of $\epsilon_1$ and a relative permeability of $\mu_1$. The relative permittivity $\epsilon_1$ is different from the relative permittivity of $\epsilon_2$, and/or the relative permeability of $\mu_1$ is different from the relative permeability of $\mu_2$. In a specific implementation, such structure is important because the material of $\epsilon_2$ and $\mu_2$ may be chosen to provide a desired resonant frequency of the resonator 1310 and, as a result, the desired central frequency of the stopband of the filter. Moreover, the use of the material of $\epsilon_2$ and $\mu_2$ with a considerable loss can give widening the stopband in the filter for the differential mode or the common mode.

Thus, it is well-understandable that differential-common mode resonant filters can be formed in a multilayer board having a different number of ground plates and which are separated by materials having different constitutive parameters. It should be also noted that the resonator may be provided at any position in the multilayer board.

Although the present invention has been described above in connection with several exemplary embodiments thereof, it would be apparent to those skilled in the art that those exemplary embodiments are provided solely for illustrating the present invention, and should not be relied upon to construe the appended claims in a limiting sense.

The invention claimed is:

1. A differential-common mode resonant filter, comprising:

a multilayer board comprising two or more conductor layers;

a resonator formed by ground plates disposed one under another in said conductor layers and ground vias connected to said ground plates;

two signal vias disposed within said resonator, passing through said resonator and isolated from said ground plates by clearance holes;

two terminals connected to said two signal vias to receive differential-mode and common-mode signals;

wherein said resonator establishes a resonant effect on said two signal vias at predetermined frequencies by means of horizontal dimensions of said resonator and a first isolating material disposed between said ground plates, wherein said resonator has a first face of symmetry perpendicular to said ground plates, and wherein said two signal vias are disposed symmetrically with respect to said first face of symmetry at a distance from said first face of symmetry providing a separation of said differential-mode and common-mode signals in a frequency domain.

2. The filter according to claim 1, wherein a relative permittivity of said first isolating material is different from that of a second isolating material disposed in other parts of said multilayer board.

3. The filter according to claim 1, wherein a relative permeability of said first isolating material is different from that of a second isolating material disposed in other parts of said multilayer board.

4. The filter according to claim 1, wherein said first isolating material is a dielectric material.

5. The filter according to claim 1, wherein said first isolating material is an electromagnetic wave absorbing material.

6. The filter according to claim 1, wherein said first isolating material is a magnetic material.

7. The filter according to claim 1, wherein said resonator additionally has a second face of symmetry perpendicular to said ground plates, and wherein said two signal vias are equally spaced from said second face of symmetry.

8. The filter according to claim 7, wherein said two signal vias lie on said second face of symmetry.

9. The filter according to claim 1, wherein side walls are arranged so as to form a circular resonator.

10. The filter according to claim 9, wherein said two signal vias are disposed symmetrically with respect to the center of said circular resonator.

11. A differential-common mode resonant filter comprising:

a multilayer board comprising two or more conductor layers;

a resonator formed by ground plates disposed one under another in said conductor layers and ground vias connected to said ground plates;

two signal vias disposed within said resonator, passing through said resonator and isolated from said ground plates by clearance holes;

two identical groups of tuning elements disposed within said resonator;

two terminals connected to said two signal vias to receive differential-mode and common-mode signals;

wherein said resonator establishes a resonant effect on said two signal vias at predetermined frequencies by means of horizontal dimensions of said resonator and a material disposed between said ground plates, wherein said resonator has a first face of symmetry perpendicular to said ground plates, wherein said two signal vias are disposed symmetrically with respect to said first face of symmetry at a distance from said first face of symmetry, wherein said resonator has a second face of symmetry perpendicular to said ground plates and passing through centers of said two signal vias, wherein each of said groups comprises one or more tuning elements, wherein said two groups of tuning elements are disposed symmetrically to each other with respect to said second face of symmetry, and wherein said one or more tuning elements are made as holes passing through said multilayer board.

12. The filter according to claim 11, wherein said one or more tuning elements are made of a metal.

13. The filter according to claim 11, wherein said one or more tuning elements are made of a dielectric material.

14. The filter according to claim 11, wherein said one or more tuning elements are made of a magnetic material.

15. The filter according to claim 11, wherein said one or more tuning elements are made of an electromagnetic wave absorbing material.

16. The filter according to claim 11, wherein the number, positions, materials and dimensions of said one or more tuning elements are chosen to provide a predetermined shift of a resonance frequency of said resonator.

17. A differential-common mode resonant filter comprising:

a multilayer board comprising two or more conductor layers;

a resonator formed by ground plates disposed one under another in said conductor layers and ground vias connected to said ground plates;

two signal vias disposed within said resonator, passing through said resonator and isolated from said ground plates by clearance holes;

two identical groups of tuning elements disposed within said resonator;

two terminals connected to said two signal vias to receive differential-mode and common- mode signals;

wherein said resonator establishes a resonant effect on said two signal vias at predetermined frequencies by means of horizontal dimensions of said resonator and a material disposed between said ground plates, wherein said resonator has a first face of symmetry perpendicular to said ground plates, wherein said two signal vias are disposed symmetrically with respect to said first face of symmetry at a distance from said first face of symmetry, wherein said resonator has a second face of symmetry perpendicular to said ground plates and passing through centers of said two signal vias, wherein each of said two groups comprises one or more tuning elements, wherein said two groups of tuning elements are symmetrical to each other with respect to said second face of symmetry, and wherein the number, positions, materials and dimensions of said tuning elements are chosen to provide reduction of the common mode.

18. A differential-common mode resonant filter comprising:

a multilayer board comprising two or more conductor layers;

a resonator formed by ground plates disposed one under another in said conductor layers and ground vias connected to said ground plates;

two signal vias disposed within said resonator, passing through said resonator, and isolated from said ground plates by clearance holes;

two identical groups of tuning elements disposed within said resonator;

two terminals connected to said two signal vias to receive differential-mode and common-mode signals;

wherein said resonator establishes a resonant effect on said two signal vias at predetermined frequencies by means of horizontal dimensions of said resonator and a material disposed between said ground plates, wherein said resonator has a first face of symmetry perpendicular to said ground plates, wherein said two signal vias are disposed symmetrically with respect to said first face of symmetry at a distance from said first face of symmetry, wherein said resonator has a second face of symmetry perpendicular to said ground plates and passing through centers of said two signal vias, wherein each of said two groups comprises one or more tuning elements, wherein said two groups of tuning elements are symmetrical to each other with respect to said second face of symmetry, and wherein the number, positions, materials and dimensions of said tuning elements are chosen to provide reduction of the common mode in a predetermined frequency band, keeping the level of the differential mode on a required level in said predetermined frequency band.

19. A method of suppressing the common mode, comprising: providing a resonator, formed by two horizontal conductor plates opposed to each other and separated by an isolating material, and vertical conductor walls connected to said horizontal conductor plates, having a first face of symmetry and a second face of symmetry; and providing a pair of signal conductors disposed through said resonator symmetrically with respect to said first face of symmetry and isolated from said horizontal conductor plates; and providing two identical groups of tuning elements disposed through said resonator symmetrically with respect to said second face of symmetry, said tuning elements being made of electromagnetic wave absorbing material.

20. A method of controlling the resonance frequency of a resonator used in differential-common mode filter, comprising: providing a resonator incorporating horizontal conductor plates opposed to each other and separated by an isolating material, and vertical conductor walls connected to said horizontal conductor plates, having a first face of symmetry and a second face of symmetry;

providing a pair of signal conductors disposed through said resonator symmetrically with respect to said first face of symmetry and isolated from said horizontal conductor plates; and providing two identical groups of tuning elements disposed through said resonator symmetrically with respect to said second face of symmetry.

21. The method according to claim 20, wherein said tuning elements are made of metal.

22. The method according to claim 20, wherein said tuning elements are made of dielectric material.

23. The method according to claim 20, wherein said tuning elements are made of magnetic material.

* * * * *

UNITED STATES PATENT AND TRADEMARK OFFICE

CERTIFICATE OF CORRECTION

PATENT NO. : 8,576,027 B2
APPLICATION NO. : 12/810200
DATED : November 5, 2013
INVENTOR(S) : Taras Kushta It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 536 days.

Signed and Sealed this
Twenty-second Day of September, 2015

Michelle K. Lee

Michelle K. Lee
*Director of the United States Patent and Trademark Office*